US008589056B2

(12) United States Patent
Hozumi et al.

(10) Patent No.: US 8,589,056 B2
(45) Date of Patent: Nov. 19, 2013

(54) STOP CONTROL SYSTEM AND METHOD FOR INTERNAL COMBUSTION ENGINE

(75) Inventors: Tomoharu Hozumi, Saitama-ken (JP); Hiroshi Yatani, Saitama-ken (JP); Takeshi Aoki, Saitama-ken (JP); Atsushi Mitsui, Saitama-ken (JP); Masaaki Nagashima, Saitama-ken (JP); Kazuhiko Imamura, Saitama-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/382,458

(22) PCT Filed: Jul. 30, 2010

(86) PCT No.: PCT/JP2010/062900
§ 371 (c)(1),
(2), (4) Date: Jan. 5, 2012

(87) PCT Pub. No.: WO2011/013799
PCT Pub. Date: Feb. 3, 2011

(65) Prior Publication Data

US 2012/0116653 A1 May 10, 2012

(30) Foreign Application Priority Data

Jul. 30, 2009 (JP) ..... 2009-177942

(51) Int. Cl.
*F02D 9/02* (2006.01)
*G07F 19/00* (2006.01)
*F02N 11/08* (2006.01)

(52) U.S. Cl.
USPC ..... 701/112; 123/179.4; 123/179.18; 123/403; 701/103

(58) Field of Classification Search
USPC ..... 701/101–105, 110–113, 115; 123/179.18, 179.3, 179.4, 350–352, 123/366, 395, 399, 403, 198 DB, 198 DC
See application file for complete search history.

(56) References Cited

U.S. PATENT DOCUMENTS 7,240,663 B2 * 7/2007 Lewis et al. ..... 123/321
7,559,304 B2 * 7/2009 Kataoka et al. ..... 123/179.4

(Continued)

FOREIGN PATENT DOCUMENTS

EP 1 582 737 A2 10/2005
JP 2005-155548 6/2005

(Continued)

OTHER PUBLICATIONS

Chines Office Action, Application No. 201080028150.3, issued Dec. 3, 2012.
Supplementary European Search Report issued on Jun. 21, 2013, in counterpart European Patent Appl. No. 10804545.1 (3 pages).

*Primary Examiner* — Willis R Wolfe, Jr.
*Assistant Examiner* — Johnny Hoang
(74) *Attorney, Agent, or Firm* — Arent Fox LLP

(57) ABSTRACT

To provide a stop control system for an internal combustion engine, which is capable of accurately stopping a piston at a predetermined position while compensating for variation in the stop characteristic of the piston and aging thereof. The stop control system 1 for the engine 3 according the present invention controls a throttle valve 13*a* toward an open side when an engine speed NE becomes lower than a stop control start rotational speed NEIGOFTH after the engine 3 is stopped (step 42), whereby a final compression stroke rotational speed NEPRSFTGT is controlled to a predetermined reference value NENPFLMTO, to thereby control the stop position of the piston 3*d* to a predetermined position. Further, the correlation between the stop control start rotational speed NEIGOFTH and the final compression stroke rotational speed NEPRSFTGT is determined (step 5, FIG. 9), and based on the determined correlation, a target stop control start rotational speed NEICOFREFX is calculate and learned (step 11), for use in the stop control.

20 Claims, 24 Drawing Sheets

(56) References Cited

U.S. PATENT DOCUMENTS

| | | | | |
|---|---|---|---|---|
| 8,265,860 | B2 * | 9/2012 | Ichinose et al. | 701/113 |
| 2007/0199533 | A1 * | 8/2007 | Takahashi | 123/179.4 |
| 2008/0091336 | A1 * | 4/2008 | Kato | 701/112 |
| 2008/0092841 | A1 * | 4/2008 | Takahashi | 123/179.16 |
| 2009/0037085 | A1 * | 2/2009 | Kojima | 701/113 |

FOREIGN PATENT DOCUMENTS

| | | | |
|---|---|---|---|
| JP | 2005-282426 | A | 10/2005 |
| JP | 2005-320909 | A | 11/2005 |
| JP | 2006-242082 | A | 9/2006 |
| JP | 2007-315316 | A | 12/2007 |
| JP | 4144516 | B2 | 6/2008 |

* cited by examiner

STOP CONTROL SYSTEM AND METHOD FOR INTERNAL COMBUSTION ENGINE

CROSS-REFERENCED TO RELATED APPLICATION

This application is a National Stage entry of International Application No. PCT/JP2010/062900, filed Jul. 30, 2010, which claims priority to Japanese Patent Application No. 177942/2009, filed Jul. 30, 2009, the disclosure of the prior applications are incorporated in their entirety by reference.

TECHNICAL FIELD

The present invention relates to a stop control system and method for an internal combustion engine, for controlling a stop position of a piston during stoppage of the engine.

BACKGROUND ART

Conventionally, as a stop control system for an internal combustion engine, one disclosed in Patent Literature 1 is known. This engine is equipped with an intake air amount-adjusting valve for adjusting the amount of intake air. Further, in this stop control system, during stoppage of the engine, the intake air amount-adjusting valve is controlled to a predetermined opening degree, whereby the magnitude of negative pressure within an intake passage is adjusted to stop the piston of the engine at a predetermined position suitable for restarting the engine. Specifically, in a process before the engine is stopped, the rotational speed of the engine is detected when the piston passes the compression top dead center, and a predetermined map is searched according to the detected rotational speed at the compression top dead center to thereby set the opening degree of the intake air amount-adjusting valve. This adjusts the rate of reduction of the rotational speed of the engine to stop the piston at the predetermined position, whereby the startability of the engine is improved at the restart thereof.

CITATION LIST

Patent Literature

[PTL 1] Japanese Patent No. 4144516

SUMMARY OF INVENTION

Technical Problem

A manner in which the piston stops during stoppage of the engine (hereinafter referred to as the "stop characteristic of the piston") varies with the magnitude of the sliding friction of the piston, the amount of intake air adjusted by the intake air amount-adjusting valve, etc., and hence it is inevitable that the stop characteristic of the piston suffers from varying depending on the difference between individual products of the pistons of the engine. Further, the stop characteristic of the piston varies in the same engine with the lapse of time. On the other hand, in the above-described conventional stop control system, the opening degree of the intake air amount-adjusting valve is merely set based on a map set in advance according to the rotational speed at the compression top dead center, it is impossible to accurately stop the piston at the predetermined position, due to adverse influence of the variation in the stop characteristic of the piston and aging thereof.

The present invention has been made to provide a solution to the above-described problems, and an object thereof is to provide a stop control system and method for an internal combustion engine, which are capable of accurately stopping a piston at a predetermined position while compensating for variation in the stop characteristic of the piston and aging thereof.

Solution to Problem

To attain the above object, the invention as claimed in claim 1 provides a stop control system 1 for an internal combustion engine 3, which controls a stop position of a piston 3*d* of the engine 3 to a predetermined position during stoppage of the engine 3 by controlling an intake air amount, comprising an intake air amount-adjusting valve (throttle valve 13*a* in the embodiment (the same applies hereinafter in this section)) for adjusting the intake air amount, rotational speed-detecting means (ECU 2, crank angle sensor 24) for detecting a rotational speed of the engine 3 (engine speed NE), intake air amount control means (ECU 2, TH actuator 13*b*, FIG. 5, FIG. 6) for controlling the intake air amount-adjusting valve toward a closed side when a command for stopping the engine 3 is issued, and thereafter when the detected rotational speed of the engine 3 becomes lower than a stop control start rotational speed (corrected target stop control start rotational speed NEICOFREFN), controlling the intake air amount-adjusting valve toward an open side, final compression stroke rotational speed-obtaining means (ECU 2, step 66 in FIG. 8) for obtaining the rotational speed of the engine 3 in a final compression stroke immediately before the engine 3 is stopped, as a final compression stroke rotational speed NEPRSFTGT, correlation determining means (ECU 2, step 5 in FIG. 4, FIG. 9) for determining a correlation between the stop control start rotational speed NEIGOFTH and the final compression stroke rotational speed NEPRSFTGT, based on the stop control start rotational speed NEIGOFTH and the final compression stroke rotational speed NEPRSFTGT obtained when the intake air amount-adjusting valve has been controlled toward the open side based on the stop control start rotational speed NEIGOFTH, and target stop control start rotational speed-setting means (ECU 2, steps 6, 9, 11 in FIG. 4) for setting a target stop control start rotational speed NEICOFREFX that serves as a target of the stop control start rotational speed NEIGOFTH, based on the determined correlation and a predetermined final compression stroke rotational speed (reference value NENPFLMT0 of final compression stroke rotational speed) for stopping the piston 3*d* at the predetermined position.

According to the stop control system for the internal combustion engine, when the command for stopping the engine is issued, the intake air amount-adjusting valve is controlled toward the open side, and thereafter when the rotational speed of the engine becomes lower than the stop control start rotational speed, the intake air amount-adjusting valve is controlled toward the open side. Thus, the intake air amount-adjusting valve is once controlled toward the closed side after the command for stopping the engine is issued, so that it is possible to prevent occurrence of uncomfortable vibration and untoward noise. Further, after that, the intake air amount is controlled by controlling the intake air amount-adjusting valve toward the open side, whereby the stop position of the piston is controlled.

Further, in the present invention, the correlation between the stop control start rotational speed and the final compression stroke rotational speed is determined based on the stop control start rotational speed and the final compression stroke rotational speed obtained when the intake air amount-adjusting valve has been controlled toward the open side based on the stop control start rotational speed. Therefore, the determined correlation reflects actual stop characteristics of the piston including variation and aging thereof. Then, the target stop control start rotational speed that serves as the target of the stop control start rotational speed is set based on the correlation and the predetermined final compression stroke rotational speed for stopping the piston at the predetermined position, and hence it is possible to accurately stop the piston at the predetermined position while compensating for variation in the stop characteristic of the piston and aging thereof.

The invention as claimed in claim 2 is the stop control system 1 as claimed in claim 1, further comprising basic value-calculating means (ECU 2, step 6 in FIG. 4, FIG. 9) for calculating the stop control start rotational speed NEIGOFTH corresponding to the predetermined final compression stroke rotational speed, based on the determined correlation, as a basic value NEICOFRRT of the target stop control start rotational speed, and averaging calculation means (ECU 2, step 11 in FIG. 4) for calculating the target stop control start rotational speed NEICOFREFX by an averaging calculation using the calculated basic value and an immediately preceding value of the target stop control start rotational speed NEICOFREFX, wherein the averaging calculation means makes larger a degree of averaging of the basic value of the target stop control start rotational speed (averaging coefficient CICOFREFX) as the number of times of the averaging calculation (number of times of learning NENGSTP) is larger.

With this configuration, the stop control start rotational speed corresponding to the predetermined final compression stroke rotational speed is calculated based on the determined correlation, as the basic value of the target stop control start rotational speed. Therefore, this basic value corresponds to the stop control start rotational speed directly derived from the correlation. Then, the target stop control start rotational speed is calculated by the averaging calculation using the basic value and the target stop control start rotational speed calculated up to the time, and is learned. Therefore, even in a case where the above-described determination of the correlation and the setting of the basic value based on the determined correlation are not properly performed due to a temporary change in the operating conditions of the engine, it is possible to properly set the target stop control start rotational speed while suppressing adverse influences caused by the improper determination and setting.

Further, in general, the stop characteristic of the piston does not steeply change, and hence as the above-described learning is repeatedly performed many more times, the reliability of the target stop control start rotational speed becomes higher. According to the present invention, when performing the averaging calculation, as the number of times of the averaging calculation (number of times of learning) is larger, the degree of averaging the basic value of the target stop control start rotational speed is made larger. Therefore, as the learning proceeds, it is possible to more properly set the target stop control start rotational speed while increasing the weight of the learned value of the target stop control start rotational speed having a higher reliability.

The invention as claimed in claim 3 is the stop control system 1 as claimed in claim 1 or 2, further comprising detection means (intake air temperature sensor 22, atmospheric pressure sensor 23, engine coolant temperature sensor 26) for detecting at least one of a temperature of intake air drawn into the engine 3 (intake air temperature TA), an atmospheric pressure PA, and a temperature of the engine 3 (engine coolant temperature TW), and target stop control start rotational speed-correcting means (ECU 2, steps 26 to 28 in FIG. 5) for correcting the target stop control start rotational speed NEICOFREFX according to at least one of the temperature of intake air drawn into the engine, the atmospheric pressure PA, and the temperature of the engine 3, which are detected.

With this configuration, at least one of the temperature of intake air, the atmospheric pressure, and the temperature of the engine is detected. These three parameters all have influence on the stop characteristic of the piston. Specifically, as the temperature of intake air and the temperature of the engine are lower, the sliding friction of the piston becomes larger, so that the piston is easy to be stopped. Further, as the atmospheric pressure is lower and as the temperature of intake air is higher, the density of intake air becomes lower and the resistance of intake air to the piston becomes smaller, so that the piston is difficult to be stopped even when the intake air amount is the same. According to the present invention, the target stop control start rotational speed is corrected according to at least one of these three detected parameters. This makes it possible to more properly set the target stop control start rotational speed according to these parameters to more accurately stop the piston at the predetermined position.

The invention as claimed in claim 4 is the stop control system 1 as claimed in any one of claims 1 to 3, further comprising first stage intake air amount control means (ECU 2, step 34 in FIG. 6) for controlling the intake air amount-adjusting valve to a first predetermined opening degree ICMDOFPRE when the rotational speed of the engine becomes lower than a first stage control start rotational speed NEICOFPRE higher than the stop control start rotational speed, after the intake air amount control means has controlled the intake air amount-adjusting valve toward the closed side, and first stage control start rotational speed-setting means (ECU 2, step 29 in FIG. 5) for setting the first stage control start rotational speed NEICOFPRE to a larger value as the target stop control start rotational speed NEICOFREFX is higher.

With this configuration, when the intake air amount-adjusting valve is to be opened from a closed state so as to stop the piston at the predetermined position, the intake air amount-adjusting valve is not opened at a time but it is controlled to the first predetermined opening degree (hereinafter referred to as the "first stage control") before the intake air amount-adjusting valve is controlled toward the open side (hereinafter referred to as the "second stage control"). As described above, the intake air amount-adjusting valve is stepwise opened by the first stage control and the second stage control, whereby it is possible to avoid a steep rise in intake pressure, thereby making it possible to prevent occurrence of untoward noise, such as flow noise, and vibration caused by the steep rise in intake pressure.

Further, as the target stop control start rotational speed at which the second stage control is to be started is higher, the first stage control start rotational speed at which the first stage control is to be started is set to a larger value. As the target stop control start rotational speed is higher, the second stage control is started in earlier timing, which shortens a time period over which the first stage control is performed, and makes intake pressure at the start of the second stage control liable to be short. Therefore, by setting the first stage control start rotational speed to a larger value as the target stop control start rotational speed is higher, as described above, it is possible to secure a time period required for the first stage control and thereby properly control the intake pressure at the start of the second stage control, whereby it is possible to more accurately stop the piston at the predetermined position.

The invention as claimed in claim 5 is the stop control system as claimed in any one of claims 1 to 3, further comprising first stage intake air amount control means (ECU 2, step 34 in FIG. 6) for controlling the intake air amount-adjusting valve to a first predetermined opening degree ICMDOFPRE when the rotational speed of the engine becomes lower than a first stage control start rotational speed NEICOFPRE higher than the stop control start rotational speed, after the intake air amount control means has controlled the intake air amount-adjusting valve toward the closed side, and first predetermined opening degree-setting means (ECU 2, steps 132, 135 in FIG. 23, FIG. 24) for setting the first predetermined opening degree ICMDOFPRE to a larger value as the target stop control start rotational speed NEICOFREFX is higher.

With this configuration, the intake air amount-adjusting valve is stepwise opened by the first stage control and the second stage control, whereby it is possible to avoid a sudden rise in intake pressure, thereby making it possible to prevent occurrence of untoward noise, such as flow noise, and vibration caused by the sudden rise in intake pressure. Further, the first predetermined opening degree, which is an opening degree of intake air amount-adjusting valve during the first stage control, is set to a larger value, as the target stop control start rotational speed is higher. As the target stop control start rotational speed is higher, the second stage control is started in earlier timing, which shortens the time period for the first stage control, and makes intake pressure at the start of the second stage control liable to be short. Therefore, if the first predetermined opening degree is set to a larger value, as described above, as the target stop control start rotational speed is higher, it is possible to increase the degree of an increase in intake pressure during the first stage control to properly control intake pressure at the start of the second stage control, whereby it is to more accurately stop the piston at the predetermined position.

The invention as claimed in claim 6 is a stop control system 1 for an internal combustion engine, which controls a stop position of a piston 3*d* of the engine 3 to a predetermined position during stoppage of the engine 3 by controlling an intake air amount, comprising an intake air amount-adjusting valve (throttle valve 13*a* in the embodiment (the same applies hereinafter in this section)) for adjusting the intake air amount, rotational speed-detecting means (ECU 2, crank angle sensor 24) for detecting a rotational speed of the engine 3 (engine speed NE), intake air amount control means (ECU 2, TH actuator 13*b*, FIG. 15, FIG. 16) for controlling an opening degree of the intake air amount-adjusting valve (target opening degree ICMDTHIGOF) toward a closed side when a command for stopping the engine 3 is issued, and thereafter toward an open side, final compression stroke rotational speed-obtaining means (ECU 2, step 66 in FIG. 8) for obtaining the rotational speed of the engine 3 in a final compression stroke immediately before the engine 3 is stopped, as a final compression stroke rotational speed NEPRSFTGT, correlation determining means (ECU 2, step 75 in FIG. 14) for determining a correlation between the opening degree of the intake air amount-adjusting valve and the final compression stroke rotational speed NEPRSFTGT, based on the opening degree of the intake air amount-adjusting valve (second stage control opening degree ATHIGOFTH) and the final compression stroke rotational speed NEPRSFTGT obtained when the opening degree of the intake air amount-adjusting valve has been controlled toward the open side, and target opening-setting means (ECU 2, steps 76, 79, 81 in FIG. 14) for setting a target opening degree (target second stage control opening degree ATHICOFREFX) that serves as a target of the opening degree of the intake air amount-adjusting valve, based on the determined correlation and a predetermined final compression stroke rotational speed (basic value NENPFLMT0 of final compression stroke rotational speed) for stopping the piston 3*d* at the predetermined position.

According to this stop control system, when the command for stopping the engine is issued, the intake air amount-adjusting valve is controlled toward the closed side, and thereafter controlled toward the open side. As described above, the intake air amount-adjusting valve is once controlled toward the closed side after the command for stopping the engine is issued, so that it is possible to prevent occurrence of uncomfortable vibration and untoward noise. Further, after that, the intake air amount is controlled by controlling the intake air amount-adjusting valve toward the open side, whereby the stop position of the piston is controlled.

Further, in the present invention, the correlation between the opening degree of the intake air amount-adjusting valve and the final compression stroke rotational speed is determined based on the opening degree of the intake air amount-adjusting valve and the final compression stroke rotational speed obtained when the opening degree of the intake air amount-adjusting valve is caused to be increased. Therefore, the determined correlation reflects actual stop characteristics of the piston including variation in the stop characteristic of the piston and aging thereof. The target opening degree that becomes the target of the opening degree of intake air amount-adjusting valve is set based on the correlation and the predetermined final compression stroke rotational speed for stopping the piston at the predetermined position, and hence it is possible to accurately stop the piston at the predetermined position while compensating for variation in the stop characteristic of the piston and aging thereof.

The invention as claimed in claim 7 is the stop control system 1 as claimed in claim 6, further comprising basic value-calculating means (ECU 2, step 76 in FIG. 14, FIG. 17) for calculating the opening degree of the intake air amount-adjusting value corresponding to the predetermined final compression stroke rotational speed, based on the determined correlation, as a basic value of the target opening degree (basic value ATHICOFRRT of target second stage control opening), and averaging calculation means (ECU 2, step 81 in FIG. 14) for calculating the target opening degree by an averaging calculation using the calculated basic value and an immediately preceding value of the target opening degree, wherein the averaging calculation means makes larger a degree of averaging of the basic value of the target opening degree (averaging coefficient CICOFREFX) as the number of times of the averaging calculation (number of times of learning NENGSTP) is larger.

With this configuration, the opening degree of the intake air amount-adjusting valve corresponding to the predetermined final compression stroke rotational speed is calculated based on the determined correlation, as the basic value of the target opening degree. Therefore, this basic value corresponds to the opening degree of the intake air amount-adjusting valve directly derived from the correlation. Then, the target opening degree is calculated by the averaging calculation using the basic value and the target opening degree calculated up to the time, and is learned. Therefore, even in a case where the determination of the correlation and the setting of the basic value based on the determined correlation, described above, are not properly performed due to a temporary change in the operating conditions of the engine, it is possible to properly set the target opening degree while suppressing adverse influences caused by the improper determination and setting.

Further, in general, the stop characteristic of the piston does not steeply change, and hence as the above-described learning is repeatedly performed many more times, the reliability of the target opening degree becomes higher. According to the present invention, when performing the averaging calculation, as the number of times of the averaging calculation (number of times of learning) is larger, the degree of averaging the basic value of the target opening degree is made larger. Therefore, as the learning proceeds, it is possible to more properly set the target opening degree while increasing the weight of the learned value of the target opening degree having a higher reliability.

The invention as claimed in claim 8 is the stop control system 1 as claimed in claim 6 or 7, further comprising detection means (intake air temperature sensor 22, atmospheric pressure sensor 23, engine coolant temperature sensor 26) for detecting at least one of a temperature of intake air drawn into the engine 3 (intake air temperature TA), an atmospheric pressure PA, and a temperature of the engine (engine coolant temperature TW), and target opening degree-correcting means (ECU 2, steps 96 to 98 in FIG. 15) for correcting the target opening degree (target second stage control opening degree ATHICOFREFX) according to at least one of the temperature of intake air drawn into the engine 3, the atmospheric pressure PA, and the temperature of the engine 3, which are detected.

With this configuration, at least one of the temperature of intake air, the atmospheric pressure and the temperature of the engine is detected. These three parameters all have influence on the stop characteristic of the piston, as mentioned hereinabove. According to the present invention, since the target opening degree is corrected according to at least one of these three parameters, it is possible to more properly set the target opening degree to more accurately stop the piston at the predetermined position.

The invention as claimed in claim 9 is the stop control system 1 as claimed in any one of claims 6 to 8, further comprising first stage intake air amount control means (ECU 2, step 34 in FIG. 6) for controlling the intake air amount-adjusting valve to a first predetermined opening degree ICMDOFPRE when the rotational speed of the engine becomes lower than a first stage control start rotational speed NEICOFPRE higher than the stop control start rotational speed NEICOFREFN for controlling the intake air amount-adjusting value toward the open side, after the intake air amount control means has controlled the intake air amount-adjusting valve toward the closed side, and first stage control start rotational speed-setting means (ECU 2, step 123 in FIG. 22) for setting the first stage control start rotational speed NEICOFPRE to a smaller value as the target opening degree is larger.

With this configuration, the intake air amount-adjusting valve is stepwise opened by the first stage control and the second stage control, whereby it is possible to avoid a steep rise in intake pressure, thereby making it possible to prevent occurrence of untoward noise, such as flow noise, and vibration caused by the steep rise in intake pressure. Further, as the target opening degree that serves as the target of the opening degree of the intake air amount-adjusting valve during the second stage control is larger, the first stage control start rotational speed is set to a smaller value. The fact that the target opening degree is set to a larger value represents that the time period for the first stage control tends to become longer since the piston is difficult to be stopped. Therefore, by setting the first stage control start rotational speed to a smaller value as the target opening degree is larger, as described above, the first stage control is started in later timing to shorten the time period for the first stage control. This makes it possible to properly control the intake pressure at the start of the second stage control, thereby making it possible to more accurately stop the piston at the predetermined position.

The invention as claimed in claim 10 is the stop control system 1 as claimed in any one of claims 6 to 8, further comprising first stage intake air amount control means (ECU 2, step 34 in FIG. 6) for controlling the intake air amount-adjusting valve to a first predetermined opening degree ICMDOFPRE when the rotational speed of the engine becomes lower than a first stage control start rotational speed NEICOFPRE higher than the stop control start rotational speed NEICOFREFN for controlling the intake air amount-adjusting value toward the open side, after the intake air amount control means has controlled the intake air amount-adjusting valve toward the closed side, and first predetermined opening degree-setting means (ECU 2, step 123 in FIG. 22) for setting the first predetermined opening degree ICMDOFPRE to a smaller value as the target opening degree is larger.

With this configuration, the intake air amount-adjusting valve is stepwise opened by the first stage control and the second stage control, whereby it is possible to avoid a steep rise in intake pressure, thereby making it possible to prevent occurrence of untoward noise, such as flow noise, and vibration caused by the steep rise in intake pressure. Further, as the target opening degree for the second stage control is larger, the first predetermined opening degree for the first stage control is set to a smaller value. The fact that the target opening degree is set to a larger value represents a state where the time period for the first stage control is liable to be longer since the piston is difficult to be stopped. Therefore, by setting the first predetermined opening degree is set to a smaller value as the target opening degree is larger, as described above, the intake air amount is reduced to suppress the rate of rise of the intake pressure during the first stage control. This makes it possible to properly control the intake pressure at the start of the second stage control, thereby making it possible to more accurately stop the piston at the predetermined position.

The invention as claimed in claim 11 is a stop control method for an internal combustion engine, which controls a stop position of a piston 3*d* of the engine 3 to a predetermined position during stoppage of the engine 3 by controlling an intake air amount, comprising a step of detecting a rotational speed of the engine 3 (engine speed NE in the embodiment (the same applies hereinafter in this section)), a step of controlling an intake air amount-adjusting valve (throttle valve 13*a*) for controlling the intake air amount, toward a closed side when a command for stopping the engine 3 is issued, and thereafter when the detected rotational speed of the engine 3 becomes lower than a stop control start rotational speed (corrected target stop control start rotational speed NEICOFREFN), controlling the intake air amount-adjusting valve toward an open side, a step of obtaining the rotational speed of the engine 3 in a final compression stroke immediately before the engine is stopped, as a final compression stroke rotational speed NEPRSFTGT, a step of determining a correlation between the stop control start rotational speed NEIGOFTH and the final compression stroke rotational speed NEPRSFTGT, based on the stop control start rotational speed NEIGOFTH and the final compression stroke rotational speed NEPRSFTGT obtained when the intake air amount-adjusting valve has been controlled toward the open side based on the stop control start rotational speed NEIGOFTH, and a step of setting a target stop control start rotational speed NEICOFREFX that serves as a target of the stop control start rotational speed, based on the determined correlation and a predetermined final compression stroke rotational speed (reference value NENPFLMT0 of final compression stroke rotational speed) for stopping the piston 3*d* at the predetermined position.

With this configuration, it is possible to obtain the same advantageous effects as provided by the above-described claim 1.

The invention as claimed in claim 12 is the stop control method as claimed in claim 11, further comprising a step of calculating the stop control start rotational speed corresponding to the predetermined final compression stroke rotational speed, based on the determined correlation, as a basic value NEICOFRRT of the target stop control start rotational speed, and a step of calculating the target stop control start rotational speed NEICOFREFX by an averaging calculation using the calculated basic value and an immediately preceding value of the target stop control start rotational speed NEICOFREFX, wherein a degree of averaging of the basic value of the target stop control start rotational speed (averaging coefficient CICOFREFX) is made larger as the number of times of the averaging calculation (number of times of learning NENGSTP) is larger.

With this configuration, it is possible to obtain the same advantageous effects as provided by the above-described claim 2.

The invention as claimed in claim 13 is the stop control method as claimed in claim 11 or 12, further comprising a step of detecting at least one of a temperature of intake air drawn into the engine 3 (intake air temperature TA), an atmospheric pressure PA, and a temperature of the engine (engine coolant temperature TW), and a step of correcting the target stop control start rotational speed NEICOFREFX according to at least one of the temperature of intake air drawn into the engine, the atmospheric pressure PA, and the temperature of the engine 3, which are detected.

With this configuration, it is possible to obtain the same advantageous effects as provided by the above-described claim 3.

The invention as claimed in claim 14 is the stop control method as claimed in any one of claims 11 to 13, further comprising a step of controlling the intake air amount-adjusting valve to a first predetermined opening degree ICMDOFPRE when the rotational speed of the engine becomes lower than a first stage control start rotational speed NEICOFPRE higher than the stop control start rotational speed, after the intake air amount-adjusting valve has been controlled toward the closed side, and a step of setting the first stage control start rotational speed ICMDOFPRE to a larger value as the target stop control start rotational speed NEICOFREFX is higher.

With this configuration, it is possible to obtain the same advantageous effects as provided by the above-described claim 4.

The invention as claimed in claim 15 is the stop control method as claimed in any one of claims 11 to 13, further comprising a step of controlling the intake air amount-adjusting valve to a first predetermined opening degree ICMDOFPRE when the rotational speed of the engine becomes lower than a first stage control start rotational speed NEICOFPRE higher than the stop control start rotational speed, after the intake air amount-adjusting valve has been controlled toward the closed side, and a step of setting the first predetermined opening degree ICMDOFPRE to a larger value as the target stop control start rotational speed NEICOFREFX is higher.

With this configuration, it is possible to obtain the same advantageous effects as provided by the above-described claim 5.

The invention as claimed in claim 16 is a stop control method for an internal combustion engine, which controls a stop position of a piston 3*d* of the engine 3 to a predetermined position during stoppage of the engine 3 by controlling an intake air amount, comprising a step of detecting a rotational speed of the engine 3 (engine speed NE in the embodiment (the same applies hereinafter in this section)), a step of controlling an opening degree (target opening degree ICMDTHIGOF) of an intake air amount-adjusting valve (throttle valve 13*a*) for adjusting the intake air amount, toward a closed side when a command for stopping the engine 3 is issued, and thereafter toward an open side, a step of obtaining the rotational speed of the engine 3 in a final compression stroke immediately before the engine 3 is stopped, as a final compression stroke rotational speed NEPRSFTGT, a step of determining a correlation between the opening degree of the intake air amount-adjusting valve and the final compression stroke rotational speed NEPRSFTGT, based on the opening degree of the intake air amount-adjusting valve (second stage control opening degree ATHIGOFTH) and the final compression stroke rotational speed NEPRSFTGT obtained when the opening degree of the intake air amount-adjusting valve has been controlled toward the open side, and a step of setting a target opening degree (target second stage control opening degree ATHICOFREFX) that serves as a target of the opening degree of the intake air amount-adjusting valve, based on the determined correlation and a predetermined final compression stroke rotational speed (basic value NENPFLMT0 of final compression stroke rotational speed) for stopping the piston 3*d* at the predetermined position.

With this configuration, it is possible to obtain the same advantageous effects as provided by the above-described claim 6.

The invention as claimed in claim 17 is the stop control method as claimed in claim 16, further comprising a step of calculating the opening degree of the intake air amount-adjusting value corresponding to the predetermined final compression stroke rotational speed, based on the determined correlation, as a basic value of the target opening degree (basic value ATHICOFRRT of target second stage control opening degree), and a step of calculating the target opening degree by an averaging calculation using the calculated basic value and an immediately preceding value of the target opening degree, wherein a degree of averaging of the basic value of the target opening degree (averaging coefficient CICOFREFX) is made larger as the number of times of the averaging calculation (number of times of learning NENGSTP) is larger.

With this configuration, it is possible to obtain the same advantageous effects as provided by the above-described claim 7.

The invention as claimed in claim 18 is the stop control method as claimed in claim 16 or 17, further comprising a step of detecting at least one of a temperature of intake air drawn into the engine (intake air temperature TA), an atmospheric pressure PA, and a temperature of the engine (engine coolant temperature TW), and a step of correcting the target opening degree (target second stage control opening degree ATHICOFREFX) according to at least one of the temperature of intake air drawn into the engine, the atmospheric pressure PA, and the temperature of the engine 3, which are detected.

With this configuration, it is possible to obtain the same advantageous effects as provided by the above-described claim 8.

The invention as claimed in claim 19 is the stop control method as claimed in any one of claims 16 to 18, further comprising a step of controlling the intake air amount-adjusting valve to a first predetermined opening degree ICMDOFPRE when the rotational speed of the engine becomes lower than a first stage control start rotational speed NEICOFPRE higher than the stop control start rotational speed, after the intake air amount-adjusting valve has been controlled toward the closed side, and a step of setting the first stage control start rotational speed NEICOFPRE to a smaller value as the target opening degree is larger.

With this configuration, it is possible to obtain the same advantageous effects as provided by the above-described claim 9.

The invention as claimed in claim 20 is the stop control method as claimed in any one of claims 16 to 18, further comprising a step of controlling the intake air amount-adjusting valve to a first predetermined opening degree ICMDOFPRE when the rotational speed of the engine becomes lower than a first stage control start rotational speed NEICOFPRE higher than the stop control start rotational speed, after the intake air amount-adjusting valve has been controlled toward the closed side, and a step of setting the first predetermined opening degree ICMDOFPRE to a smaller value as the target opening degree is larger.

With this configuration, it is possible to obtain the same advantageous effects as provided by the above-described claim 10.

MODE FOR CARRYING OUT INVENTION

Figure 1:
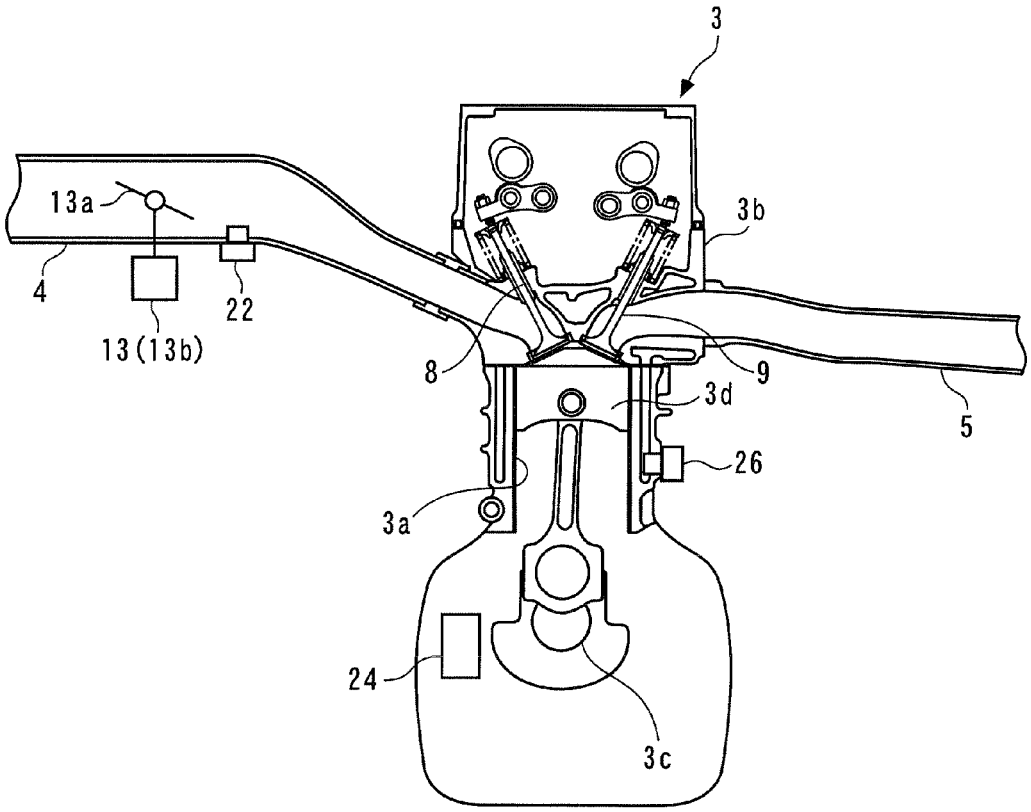
FIG. 1 A schematic view of an internal combustion engine to which a stop control system according to the present embodiment is applied.
Figure 2:
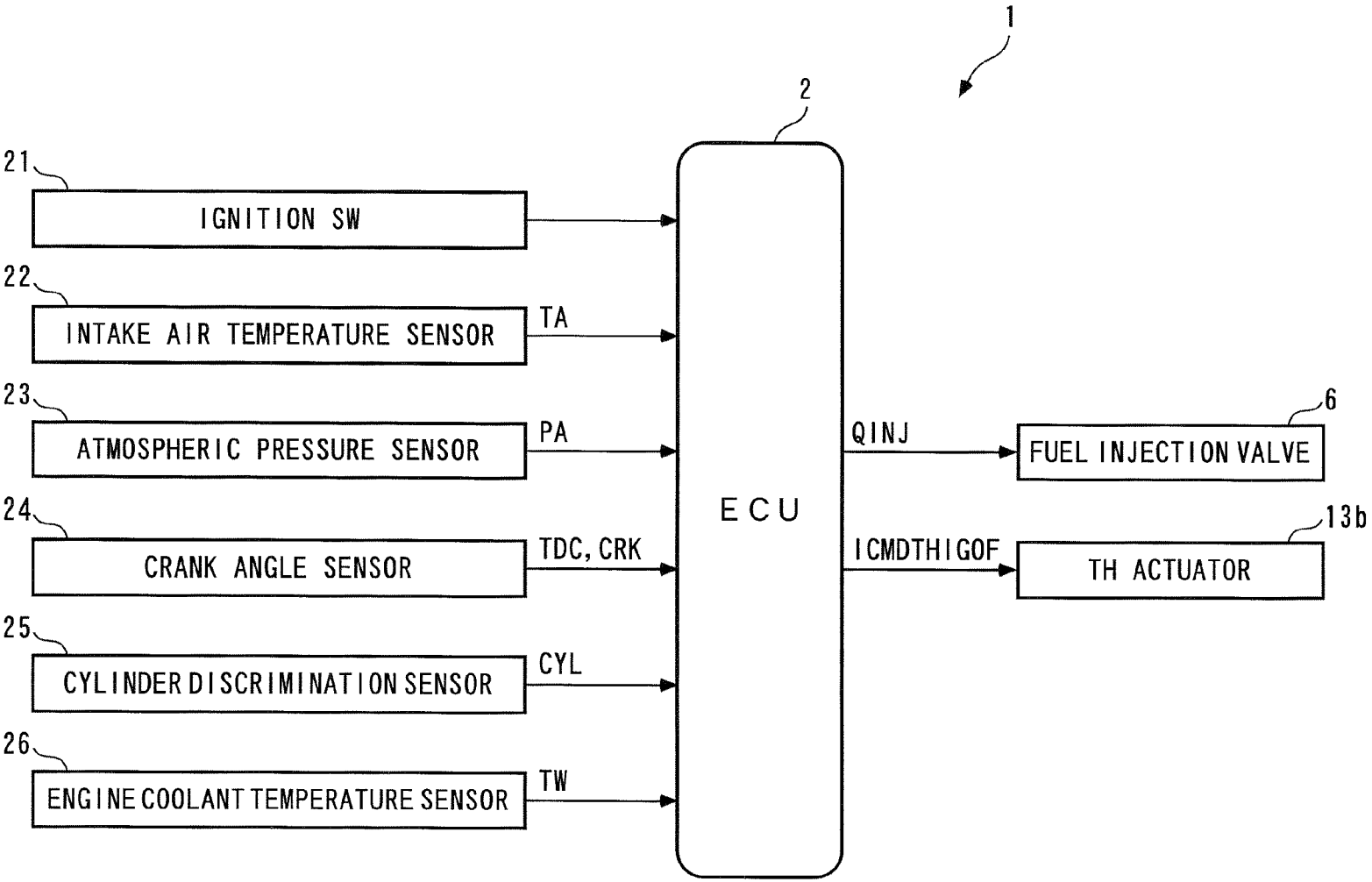
FIG. 2 A block diagram of the stop control system.

The present invention will now be described in detail with reference to the drawings showing preferred embodiments thereof. FIG. 1 schematically shows an internal combustion engine 3 to which is applied a stop control system 1 (see FIG. 2) according to the present embodiment. This internal combustion engine (hereinafter referred to as the "engine") 3 is a six-cylinder gasoline engine, for example.

Fuel injection valves 6 (see FIG. 2) are mounted on respective cylinders 3*a* of the engine 3. The opening and closing of each fuel injection valve 6 is controlled by a control signal from an ECU 2 (see FIG. 2), whereby fuel injection timing is controlled by valve-opening timing of the fuel injection valve 6, and a fuel injection amount QINJ is controlled by a valve-opening time period thereof.

Cylinder heads 3*b* of respective cylinders 3*a* of the engine 3 are connected to an intake pipe 4 and an exhaust pipe 5, cylinder by cylinder, and a pair of intake valves 8 and 8 (only one of which is shown) and a pair of exhaust valves 9 and 9 (only one of which is shown) are provide for each cylinder head 3*b*.

Figure 3:
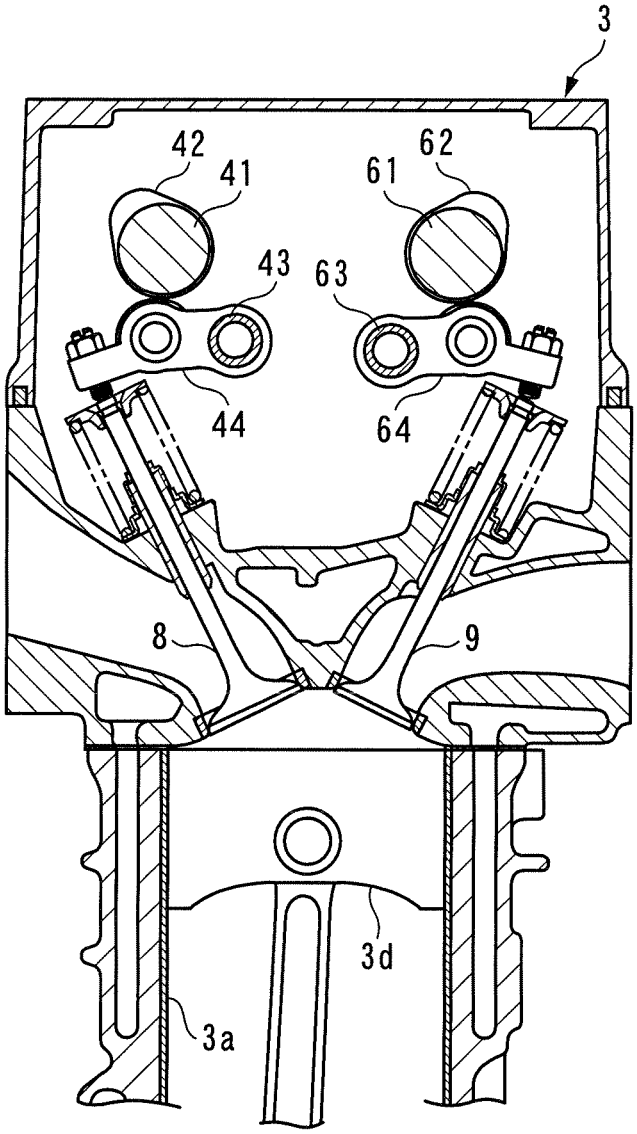
FIG. 3 A schematic cross-sectional view of an intake valve, an exhaust valve, and a mechanism for actuating the intake valve and the exhaust valve.

As shown in FIG. 3, the cylinder head 3*b* is provide therein with a rotatable intake cam shaft 41, an intake cam 42 integrally formed with the intake cam shaft 41, a rocker arm shaft 43, and two rocker arms 44 and 44 (only one of which is shown) which are pivotally supported by the rocker arm shaft 43 for being brought into abutment with respective top ends of the intake valves 8 and 8.

The intake cam shaft 41 is connected to a crankshaft 3*c* (see FIG. 1) via an intake sprocket and a timing chain (neither of which is shown), and rotates once whenever the crankshaft 3*c* rotates twice. As the intake cam shaft 41 is rotated, the rocker arms 44 and 44 are pressed by the intake cam 42 to be pivotally moved about the rocker arm shaft 43, whereby the intake valves 8 and 8 are opened and closed.

Further, the cylinder head 3*b* is provided therein with a rotatable exhaust cam shaft 61, an exhaust cam 62 integrally formed with the exhaust cam shaft 61, a rocker arm shaft 63, and two rocker arms 64 and 64 (only one of which is shown) which are pivotally supported by the rocker arm shaft 63 for being brought into abutment with respective top ends of the exhaust valves 9 and 9.

The exhaust cam shaft 61 is connected to the crankshaft 3*c* via an exhaust sprocket and a timing chain (neither of which is shown), and rotates once whenever the crankshaft 3*c* rotates twice. As the exhaust cam shaft 61 is rotated, the rocker arms 64 and 64 are pressed by the exhaust cam 62 to be pivotally moved about the rocker arm shaft 63, whereby the exhaust valves 9 and 9 are opened and closed.

Further, the intake cam shaft 41 is provided with a cylinder discrimination sensor 25. Along with rotation of the intake cam shaft 41, the cylinder discrimination sensor 25 delivers a CYL signal, which is a pulse signal, to the ECU 2 at a predetermined crank angle position of a specific cylinder 3*a*.

The crankshaft 3*c* is provided with a crank angle sensor 24. The crank angle sensor 24 delivers a TDC signal and a CRK signal, which are both pulse signals, to the ECU 2 along with rotation of the crankshaft 3*c*. The TDC signal indicates that a piston 3*d* of one of the cylinders 3*a* is at a predetermined crank angle position in the vicinity of the top dead center (TDC) at the start of the intake stroke thereof, and in the case of the six-cylinder engine as in the present embodiment, it is delivered whenever the crankshaft 3*c* rotates through 120°. The CRK signal is delivered whenever the crankshaft 3*c* rotates through a predetermined angle (e.g. 30°). The ECU 2 calculates the rotational speed of the engine 3 (hereinafter referred to as "the engine speed") NE based on the CRK signal. This engine speed NE represents the rotational speed of the engine 3. Further, the ECU 2 determines which cylinders 3*a* is in the compression stroke, based on the CYL signal and the TDC signal, and assigns cylinder numbers CUCYL 1 to 6 to the respective cylinders 3*a*, based on results of the determination.

Furthermore, the ECU 2 calculates a crank angle CA based on the TDC signal and the CRK signal, and sets a stage number STG. Assuming that a reference angle position of the crank angle CA, which corresponds to a start of the intake stroke in one of the cylinders 3*a*, is set to 0°, the stage number STG is set to 0 when the crank angle CA is within a range of $0 \leq CA < 30$, to 1 when the same is within a range of $30 \leq CA < 60$, to 2 when the same is within a range of $60 \leq CA < 90$, and to 3 when the same is within a range of $90 \leq CA < 120$. That is, the stage number STG=0 represents that one of the cylinders 3*a* is in an initial stage of the intake stroke, and at the same time, that since the engine 3 has six cylinders, another of the cylinders 3*a* is in an middle stage of the compression stroke, more specifically, is during a time period corresponding to its crank angle range of 60° to 90° after the start of the compression stroke.

The intake pipe 4 is provided with a throttle valve mechanism 13. The throttle valve mechanism 13 has a throttle valve 13*a* which is pivotally provided in the intake pipe 4 and a TH actuator 13*b* for actuating the throttle valve 13*a*. The TH actuator 13*b* is a combination of a motor and a gear mechanism (neither of which is shown), and is driven by a control signal based on a target opening degree ICMDTHIGOF delivered from the ECU 2. This varies the opening degree of the throttle valve 13*a*, whereby the amount of fresh air drawn into each cylinder 3*a* (hereinafter referred to as the "fresh air amount") is controlled.

Further, an intake air temperature sensor 22 is disposed in the intake pipe 4 at a location downstream of the throttle valve 13*a*. The intake air temperature sensor 22 detects the temperature of intake air (hereinafter referred to as the "intake air temperature") TA, and delivers a detection signal indicative of the detected intake air temperature TA to the ECU 2.

Furthermore, delivered to the ECU 2 are a detection signal indicative of atmospheric pressure PA from an atmospheric pressure sensor 23, and a detection signal indicative of the temperature of engine coolant of the engine 3 (hereinafter referred to as "the engine coolant temperature") TW from an engine coolant temperature sensor 26.

Further, a signal indicative of an on/off state of an ignition switch (SW) 21 is delivered from the ignition switch 21 to the ECU 2. Note that during stoppage of the engine 3, when the ignition switch 21 is turned off, supply of fuel from the fuel injection valve 6 to the cylinders 3*a* is stopped.

The ECU 2 is implemented by a microcomputer comprising an I/O interface, a CPU, a RAM, and a ROM (none of which are specifically shown). The detection signals from the aforementioned switch and sensors 21 to 26 are input to the CPU after the I/O interface performs A/D conversion and waveform shaping thereon. Based on the detection signals from the above-mentioned switch and sensors, the ECU 2 determines operating conditions of the engine 3 in accordance with control programs stored in the ROM, and executes control of the engine 3 including stop control, based on the determined operating conditions.

Note that in the present embodiment, the ECU 2 corresponds to intake air amount control means, final compression stroke rotational speed-obtaining means, correlation determining means, target stop control start rotational speed-setting means, basic value-calculating means, averaging calculation means, target stop control start rotational speed-correcting means, first stage intake air amount control means, first stage control start rotational speed-setting means, first predetermined opening degree-setting means, target opening degree-setting means, and target opening degree-correcting means.

Next, a stop control process of the engine 3 according to the first embodiment of the present invention will be described with reference to FIGS. 4 to 13. The present process is carried out whenever the crankshaft rotates through a crank angle CA of 30°.

The stop control of the engine 3 is for controlling the stop position of the piston 3*d* to a predetermined position at which no valve overlap occurs in which the intake valve 8 and the exhaust valve 9 open at the same time, by controlling the throttle valve 13*a* to open wider when the engine speed NE becomes lower than a stop control start rotational speed NEIGOFTH after the ignition switch 21 has been turned off, to thereby control the engine speed NE in the final compression stroke immediately before stoppage of the piston 3*d* (final compression stroke rotational speed NEPRSFTGT) to a predetermined reference value.

Figure 4:
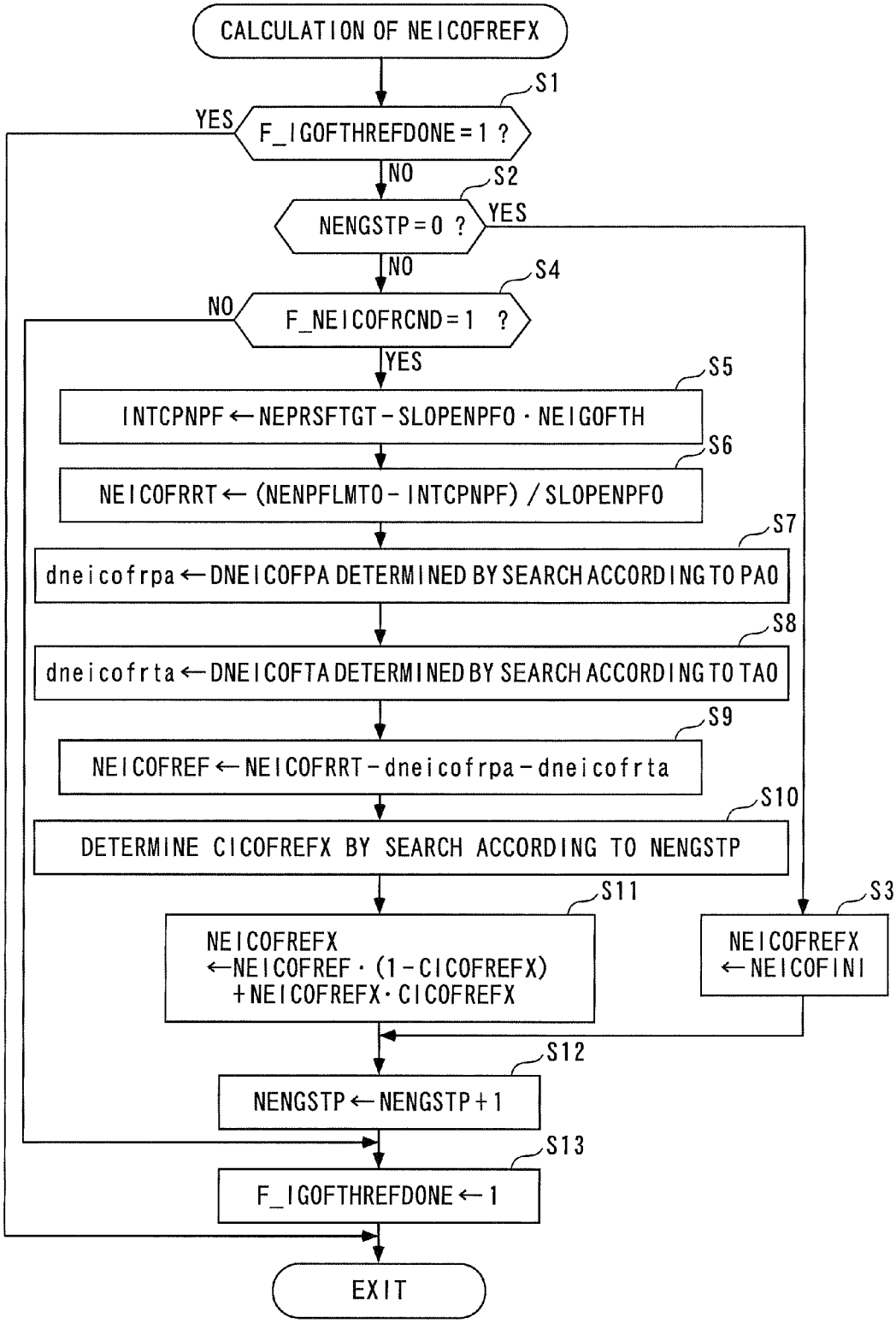
FIG. 4 A flowchart of a process for setting a target stop control start rotational speed according to a first embodiment.

FIG. 4 shows a process for setting a target stop control start rotational speed NEICOFREFX. This process is for setting a target value of the stop control start rotational speed for starting control of the throttle valve 13*a* to open wider in the stop control (second stage control, described hereinafter) as a target stop control start rotational speed NEICOFREFX, and for learning the target value. The present process is carried out once in a single stop control process.

In the present process, first, in a step 1 (shown as "S1" in FIG. 4; the following steps are also shown in the same way), it is determined whether or not a target stop control start rotational speed setting completion flag F_IGOFTHREF-DONE is equal to 1. If the answer to this question is affirmative (YES), i.e. if the target stop control start rotational speed NEICOFREFX has already been set, the present process is immediately terminated.

On the other hand, if the answer to the question of the step 1 is negative (NO), i.e. if the target stop control start rotational speed NEICOFREFX has not yet been set, in a step 2, it is determined whether or not the number of times of learning NENGSTP is equal to 0. If the answer to this question is affirmative (YES), i.e. if the number of times of learning NENGSTP has been reset e.g. by battery cancellation, the target stop control start rotational speed NEICOFREFX is set to a predetermined initial value NEICOFINI (step 3), and then the process proceeds to a step 12, referred to hereinafter.

On the other hand, if the answer to the question of the step 2 is negative (NO), it is determined in a step 4 whether or not a learning condition satisfied flag F_NEICOFRCND is equal to 1. This learning condition satisfied flag F_NEICOFRCND is set to 1 when there are satisfied predetermined learning conditions for learning the target stop control start rotational speed NEICOFREFX, including a condition that no engine stall is caused and a condition that the engine coolant temperature TW is not in a low temperature state where it is not higher than a predetermined value. If the answer to the question of the step 4 is negative (NO), i.e. if the learning conditions are not satisfied, the target stop control start rotational speed NEICOFREFX is not learned, but the process proceeds to a step 13, referred to hereinafter.

On the other hand, if the answer to the question of the step 4 is affirmative (YES), i.e. if the learning conditions for learning the target stop control start rotational speed NEICOFREFX are satisfied, the process proceeds to a step 5, wherein an intercept INTCPNPF is calculated using the final compression stroke rotational speed NEPRSFTGT obtained at the time of the immediately preceding stop control, the stop control start rotational speed NEIGOFTH, and a predetermined slope SLOPENPF0, by the following equation (1)

$$INTCPNPF = NEPRSFTGT - SLOPENPF0 \cdot NEIGOFTH \quad (1)$$

Figure 9:
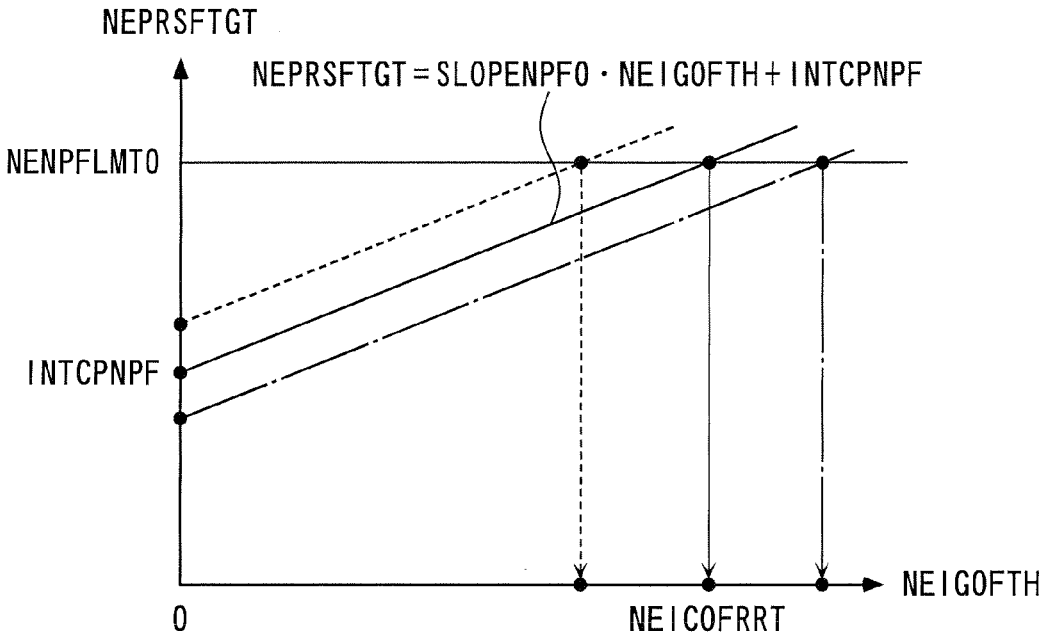
FIG. 9 A view of a correlation between a stop control start rotational speed and the final compression stroke rotational speed according to the first embodiment.

This equation (1) is based on preconditions that a correlation as shown in FIG. 9, i.e. a correlation expressed by a linear function having a slope of SLOPENPF0 and an intercept of INTCPNPF holds between the stop control start rotational speed NEIGOFTH and the final compression stroke rotational speed NEPRSFTGT, and the slope SLOPENPF0 is constant if the engine 3 is of the same type. The intercept INTCPNPF is calculated according to the above preconditions, using the stop control start rotational speed NEIGOFTH obtained during the stop control and the final compression stroke rotational speed NEPRSFTGT, by the equation (1), whereby the correlation between the stop control start rotational speed NEIGOFTH and the final compression stroke rotational speed NEPRSFTGT is determined. Incidentally, as the friction of the piston 3*d* is larger, the final compression stroke rotational speed NEPRSFTGT takes a smaller value with respect to the same control start rotational speed NEICOFRRT, so that the linear function is offset toward a lower side (as indicated by a two-dot chain line in FIG. 9, for example), and the intercept INTCPNPF is calculated to be a smaller value. Inversely, as the friction of the piston 3*d* is smaller, the linear function is offset toward an upper side (as indicated by broken lines in FIG. 9, for example) for the converse reason to the above, and the intercept INTCPNPF is calculated to be a larger value.

Then, in a step 6, a basic value NEICOFRRT of the target stop control start rotational speed is calculated based on the correlation determined as described above, by using the calculated intercept INTCPNPF and slope SLOPENPF0 and applying a predetermined reference value NENPFLMT0 of the final compression stroke rotational speed to the following equation (2) (see FIG. 9).

$$NEICOFRRT = (NENPFLMT0 - INTCPNPF)/SLOPENPF0 \quad (2)$$

The reference value NENPFLMT0 of the final compression stroke rotational speed corresponds to such a value that will cause the piston 3*d* to stop at a predetermined position free from occurrence of valve overlap, when the final compression stroke rotational speed NEPRSF is controlled to the reference value NENPFLMT0. The reference value NENPFLMT0 is determined empirically e.g. by experiment in advance, and is set to e.g. 260 rpm in the present embodiment. Therefore, by using the basic value NEICOFRRT of the target stop control start rotational speed calculated by the above-mentioned equation (2), it is possible to stop the piston 3*d* at the predetermined position.

Figure 10:
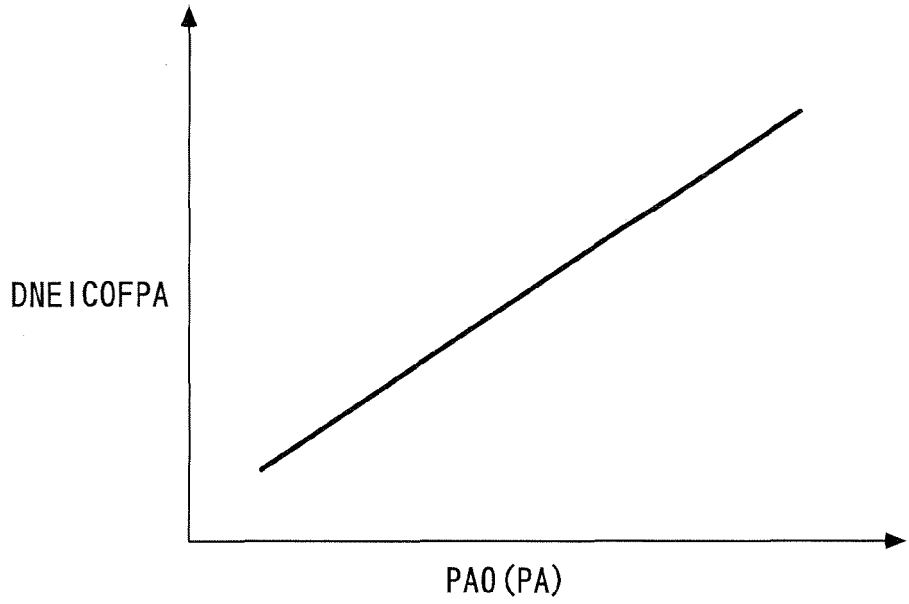
FIG. 10 A map for use in setting a learning PA correction term and a setting PA correction term according to the first embodiment.

Next, in a step 7, a map shown in FIG. 10 is searched according to the atmospheric pressure PA0 detected during the stop control to determine a map value DNEICOFPA, and the map value DNEICOFPA is set as a learning PA correction term dneicofrpa. In this map, the map value DNEICOFPA (=learning PA correction term dneicofrpa) is set to a larger value as the atmospheric pressure PA0 is higher.

Figure 11:
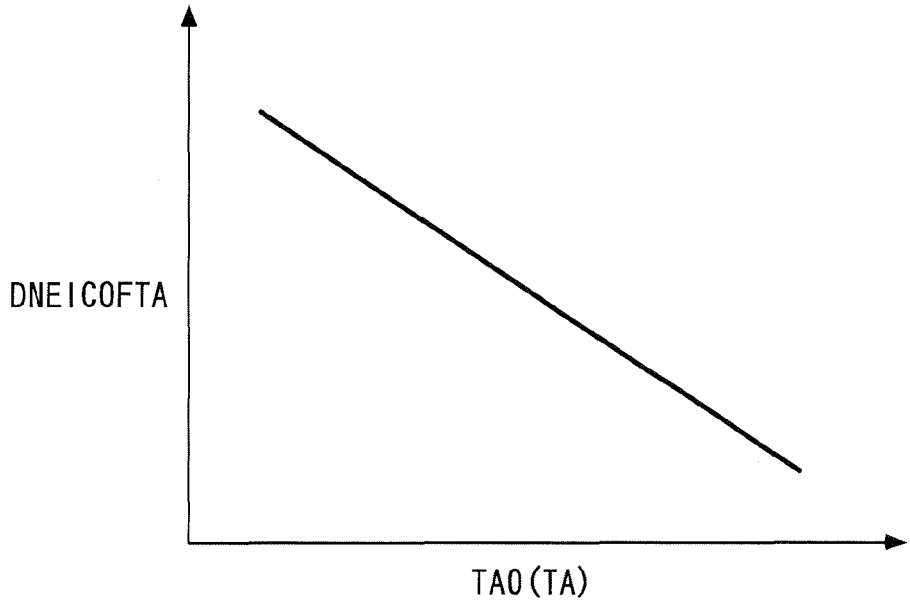
FIG. 11 A map for use in setting a learning TA correction term and a setting TA correction term according to the first embodiment.

Next, in a step 8, a map shown in FIG. 11 is searched according to an intake air temperature TA0 detected during the stop control to determine a map value DNEICOFTA, and the map value DNEICOFTA is set as a learning TA correction term dneicofrta. In this map, the map value DNEICOFTA (=learning TA correction term dneicofrta) is set to a larger value as the intake air temperature TA0 is lower.

Next, a corrected basic value NEICOFREF of the target stop control start rotational speed is calculated using the basic value NEICOFRRT of the target stop control start rotational speed, the learning PA correction term dneicofrpa, and the learning TA correction term dneicofrta calculated in the steps 6 to 8, by the following equation (3) (step 9):

$$NEICOFREF = NEICOFRRT - dneicofrpa - dneicofrta \quad (3)$$

As described hereinabove, since the learning PA correction term dneicofrpa is set to a larger value as the atmospheric pressure PA0 is higher, the corrected basic value NEICOFRRT of the target stop control start rotational speed is corrected to a smaller value as the atmospheric pressure PA0 is higher. Further, since the learning TA correction term dneicofrta set to a larger value as the intake air temperature TA0 is lower, the corrected basic value NEICOFREF of the target stop control start rotational speed is corrected to a smaller value as the intake air temperature TA0 is lower.

Figure 12:
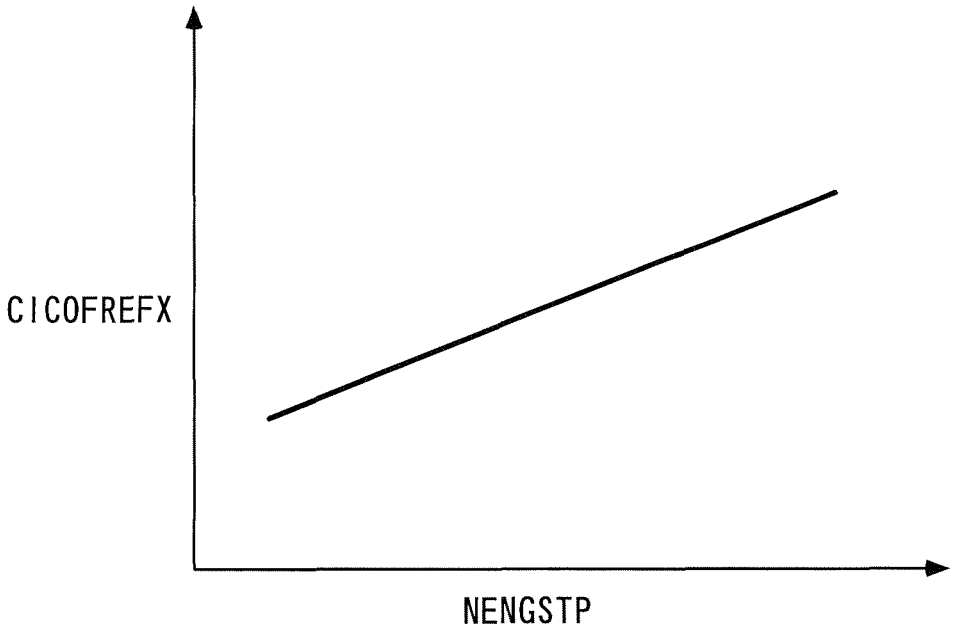
FIG. 12 A map for use in calculating an averaging coefficient.

Next, in a step 10, an averaging coefficient CICOFREFX is calculated by searching a map shown in FIG. 12 according to the number of times of learning NENGSTP. In this map, the averaging coefficient CICOFREFX is set to a larger value as the number of times of learning NENGSTP is larger ($0 < CICOFREFX < 1$).

Next, in a step 11, a current value NEICOFREFX of the target stop control start rotational speed is calculated using the calculated corrected basic value NEICOFREF of the target stop control start rotational speed, an immediately preceding value NEICOFREFX of the target stop control start rotational speed, and the averaging coefficient CICOFREFX, by the following equation (4):

$$NEICOFREFX=NEICOFREF\cdot(1-CICOFREFX)+NEICOFREFX\cdot CICOFREFX \quad (4)$$

As is clear from the above equation (4), the target stop control start rotational speed NEICOFREFX is calculated as a weighted average value of the corrected basic value NEICOFREF of the target stop control start rotational speed and the immediately preceding value NEICOFREFX of the target stop control start rotational speed, and the averaging coefficient CICOFREFX is used as a weight coefficient for weighted averaging. Therefore, the current value NEICOFREFX of the target stop control start rotational speed is calculated such that it becomes closer to the corrected basic value NEICOFREF of the target stop control start rotational speed as the averaging coefficient CICOFREFX is smaller, whereas it becomes closer to the immediately preceding value NEICOFREFX of the target stop control start rotational speed as the averaging coefficient CICOFREFX is larger. Further, the averaging coefficient CICOFREFX is set as described above according to the number of times of learning NENGSTP, and therefore as the number of times of learning NENGSTP is smaller, the degree of reflection of the corrected basic value NEICOFREF of the target stop control start rotational speed becomes larger, whereas as the number of times of learning NENGSTP is larger, the degree of reflection of the immediately preceding value NEICOFREFX of the target stop control start rotational speed becomes larger.

In the step 12 following the step 3 or 11, the number of times of learning NENGSTP is incremented. Further, if the answer to the question of the step 4 is negative (NO), or after the step 12, the proceeds to the step 13, wherein in order to indicate that the setting of the target stop control start rotational speed NEICOFREFX has been completed, the target stop control start rotational speed setting completion flag F_IGOFTHREFDONE is set to 1, followed by terminating the present process.

Figure 5:
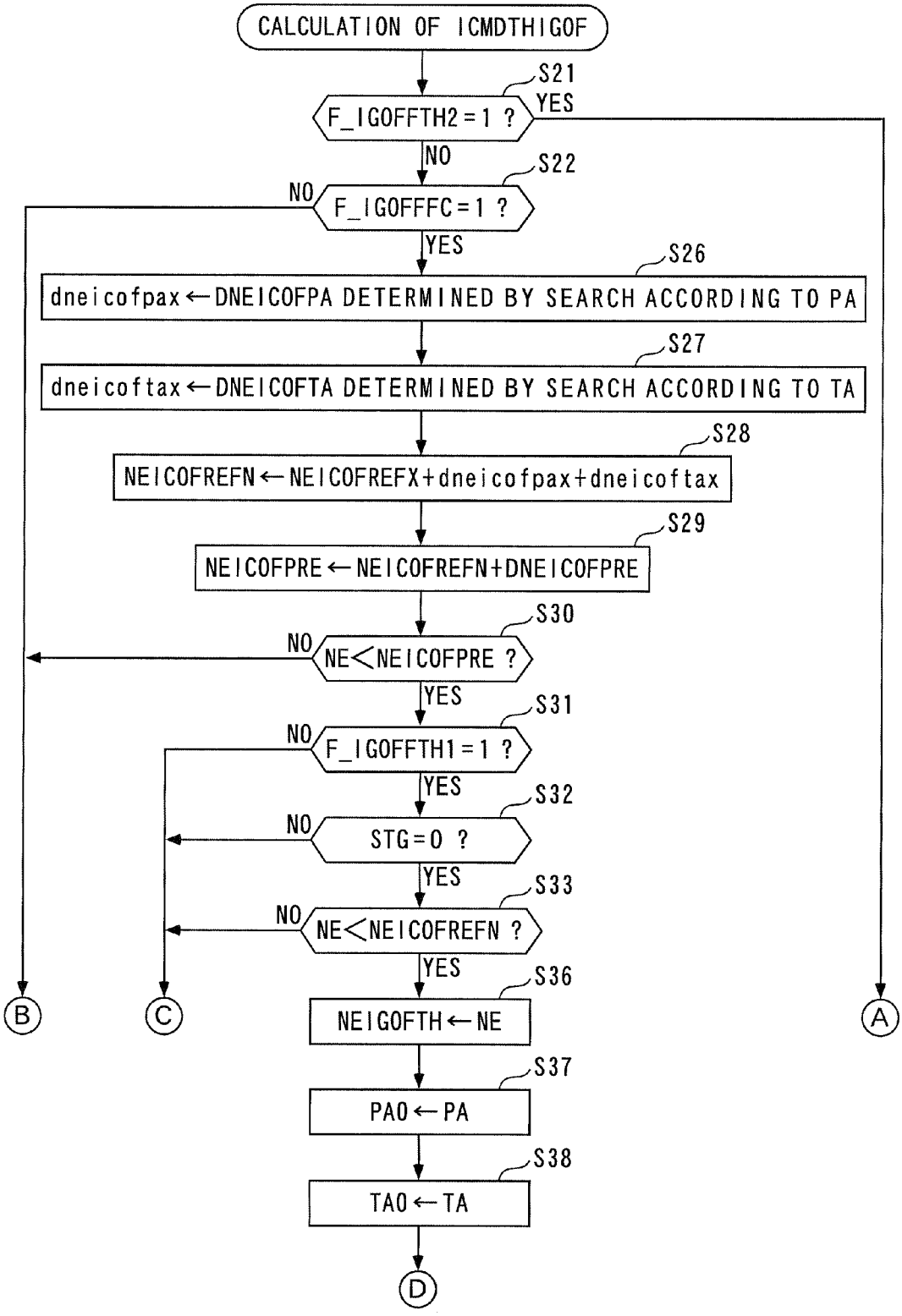
FIG. 5 A flowchart of a process for setting a target opening degree of a throttle valve according to the first embodiment.
Figure 6:
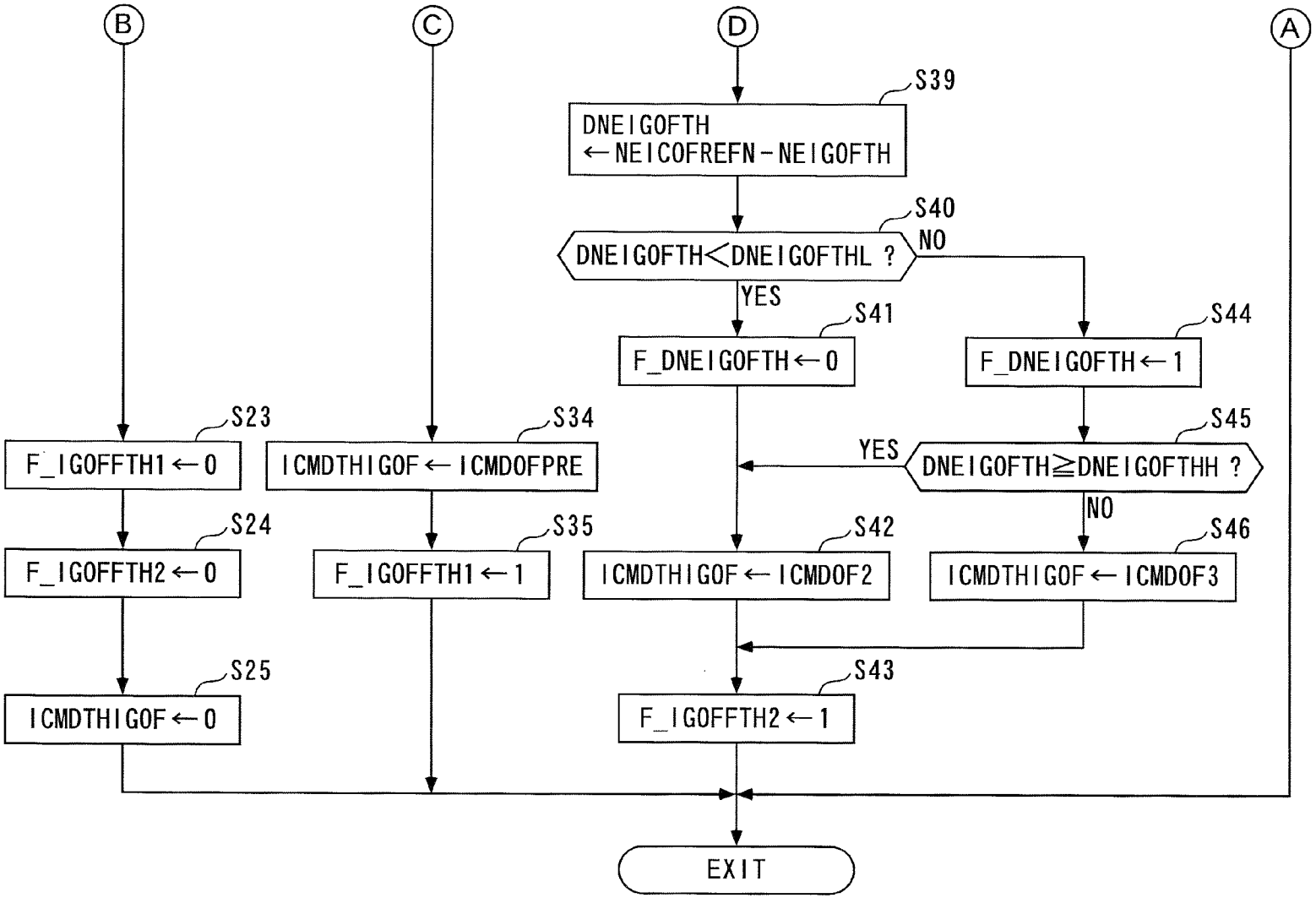
FIG. 6 A flowchart of a remaining part of the FIG. 5 setting process.

FIGS. 5 and 6 show a process for setting a target opening degree ICMDTHIGOF that serves as a target of the opening degree of the throttle valve 13*a*. In this process, after turning off the ignition switch 21, fully-closing control for controlling the target opening degree ICMDTHIGOF of the throttle valve 13*a* to 0, first stage control for setting the target opening degree ICMDTHIGOF to a first predetermined opening degree, and second stage control for setting the target opening degree ICMDTHIGOF to a second predetermined opening degree larger than the first predetermined opening degree are performed in the mentioned order according to the engine speed NE.

In the present process, first, in a step 21, it is determined whether or not a second stage control execution flag F_IGOFFTH2 is equal to 1. This second stage control execution flag F_IGOFFTH2 is set to 1 during execution of the above-described second stage control, and otherwise set to 0. If the answer to the question of the step 21 is affirmative (YES), the present process is immediately terminated.

On the other hand, if the answer to the question of the step 21 is negative (NO), it is determined in a step 22 whether or not a fuel cut flag F_IGOFFFC is equal to 1. If the answer to this question is negative (NO), i.e. if interruption of fuel supply to the engine 3 has not been completed yet after turning off the ignition switch 21, a first stage control execution flag F_IGOFFTH1 and the second stage control execution flag F_IGOFFTH2 are set to 0 (steps 23 and 24), respectively, and the target opening degree ICMDTHIGOF is set to 0 (step 25), followed by terminating the present process.

On the other hand, if the answer to the question of the step 22 is affirmative (YES), i.e. if the interruption of fuel supply to the engine 3 has been completed, the above-mentioned map shown in FIG. 10 is searched according to the atmospheric pressure PA currently detected to thereby determine the map value DNEICOFPA, and the map value DNEICOFPA is set as a setting PA correction term dneicofpax (step 26).

Next, in a step 27, the above-mentioned map shown in FIG. 11 is searched according to the intake air temperature TA currently detected to thereby determine the map value DNEICOFTA, and the map value DNEICOFTA is set as a setting TA correction term dneicoftax.

Next, in a step 28, a corrected target stop control start rotational speed NEICOFREFN is calculated using the target stop control start rotational speed NEICOFREFX set in the step 11 in FIG. 4, the setting PA correction term dneicofpax, and the setting TA correction term dneicoftax calculated as described above, by the following equation (5):

$$NEICOFREFN=NEICOFREFX+dneicofpax+dneicoftax \quad (5)$$

As described hereinabove, since the setting PA correction term dneicofpax is set to a larger value as the atmospheric pressure PA is higher, the corrected target stop control start rotational speed NEICOFREFN is corrected to a larger value as the atmospheric pressure PA is higher. This is for the following reason:

As the atmospheric pressure PA is higher, the density of intake air is higher and the resistance of intake air to the piston 3*d* is larger, so that the rate of reduction of the engine speed NE becomes larger. Further, after a control signal based on the target opening degree ICMDTHIGOF is delivered, there occurs a delay before the opening degree of the throttle valve 13*a* becomes commensurate with the control signal, and a further delay occurs before an intake air amount becomes large enough to be commensurate with the opening degree of the throttle valve 13*a*. Therefore, by correcting the corrected target stop control start rotational speed NEICOFREFN to a larger value as the atmospheric pressure PA is higher, and starting the second stage control in earlier timing, it is possible to properly avoid the adverse influence of the operation of the throttle valve 13*a* and the delay of intake air, described above.

On the other hand, since the setting TA correction term dneicoftax is set to a larger value as the intake air temperature TA is lower, the corrected target stop control start rotational speed NEICOFREFN is corrected to a larger value as the intake air temperature TA is lower. As the intake air temperature TA is lower, the sliding friction of the piston 3*d* is larger and the density of intake air is higher, which increases the rate of reduction of the engine speed NE. Therefore, by correcting the corrected target stop control start rotational speed NEICOFREFN to a larger value as the intake air temperature TA is lower and starting the second stage control in earlier timing, it is possible to properly avoid the adverse influence of the operation of the throttle valve 13*a* and the delay of intake air.

Next, in a step 29, a value obtained by adding a predetermined value DNEICOFPRE to the corrected target stop control start rotational speed NEICOFREFN (=NEICOFREFN+DNEICOFPRE) is calculated as a first stage control start rotational speed NEICOFPRE.

Then, in a step 30, it is determined whether or not the engine speed NE is smaller than the calculated first stage control start rotational speed NEICOFPRE. If the answer to this question is negative (NO), i.e. if NE≥NEICOFPRE holds, the above-described steps 23 to 25 are executed, followed by terminating the present process.

On the other hand, if the answer to the question of the step 30 is affirmative (YES), i.e. if the engine speed NE is smaller than the first stage control start rotational speed NEICOFPRE, it is determined whether or not the first stage control execution flag F_IGOFFTH1 is equal to 1 (step 31). If the answer to this question is negative (NO), i.e. if the first stage control has not been executed yet, the target opening degree ICMDTHIGOF is set to the first predetermined opening degree ICMDOFPRE for use in the first stage control (step 34), and to indicate that the first stage control is being executed, the first stage control execution flag F_IGOFFTH1 is set to 1 (step 35), followed by terminating the present process.

On the other hand, if the answer to the question of the step 31 is affirmative (YES), i.e. if the first stage control is being executed, it is determined whether or not the stage number STG is 0 (step 32). If the answer to this question is negative (NO), i.e. if none of the cylinders 3*a* are in the middle stage of the compression stroke, the above-described steps 34 and 35 are executed, followed by terminating the present process.

On the other hand, if the answer to the question of the step 32 is affirmative (YES), i.e. if the stage number STG is 0, more specifically, if any of the cylinders 3*a* is in the middle stage of the compression stroke, it is determined whether or not the engine speed NE is smaller than the corrected target stop control start rotational speed NEICOFREFN calculated in the step 28 (step 33). If the answer to this question is negative (NO), i.e. if NEICOFREFN≤NE<NEICOFPRE holds, the above-described steps 34 and 35 are executed to thereby continue the first stage control, followed by terminating the present process.

On the other hand, if the answer to the question of the step 33 is affirmative (YES), i.e. if the stage number STG is 0, and at the same time if the engine speed NE is lower than the corrected target stop control start rotational speed NEICOFREFN, the process proceeds to a step 36, wherein the engine speed NE obtained at the time is stored as an actual stop control start rotational speed NEIGOFTH, and the atmospheric pressure PA and intake air temperature TA currently detected are stored as the atmospheric pressure PA0 and intake air temperature TA0 detected during the stop control, respectively, (steps 37 and 38). The stored stop control start rotational speed NEIGOFTH is used in the aforementioned equation (1), and the atmospheric pressure PA0 and the intake air temperature TA0 are used in the steps 7 and 8 in FIG. 4 for calculating the learning PA correction term dneicofrpa and the learning TA correction term dneicofrta, respectively.

In a step 39 following the step 38, the difference between the corrected target stop control start rotational speed NEICOFREFN and the actual stop control start rotational speed NEIGOFTH (=NEICOFREFN−NEIGOFTH) is calculated as a difference DNEIGOFTH.

Next, in a step 40, it is determined whether or not the above difference DNEIGOFTH is smaller than a predetermined first reference value DNEIGOFTHL. If the answer to this question is affirmative (YES), it is judged that the difference DNEIGOFTH is small, and hence to indicate the fact, a rotational speed difference flag F_DNEIGOFTH is set to 0 (step 41), and the target opening degree ICMDTHIGOF is set to the second predetermined opening degree ICMDOF2 for use in the second stage control (step 42). This second predetermined opening degree ICMDOF2 is larger than the first predetermined opening degree ICMDOFPRE for use in the first stage control. Then, to indicate that the second stage control is being executed, the second stage control execution flag F_IGOFFTH2 is set to 1 (step 43), followed by terminating the present process.

On the other hand, if the answer to the question of the step 40 is negative (NO), i.e. if DNEIGOFTH≥DNEIGOFTHL holds, it is judged that the difference between the corrected target stop control start rotational speed NEICOFREFN and the actual stop control start rotational speed NEIGOFTH is large, and hence to indicate the fact, the rotational speed difference flag F_DNEIGOFTH is set to 1 (step 44). Then, it is determined whether or not the difference DNEIGOFTH is not smaller than a predetermined second reference value DNEIGOFTHH which is larger than the first reference value DNEIGOFTHL (step 45). If the answer to this question is affirmative (YES), i.e. if DNEIGOFTH≥DNEIGOFTHH holds, the process proceeds to the step 42, wherein the target opening degree ICMDTHIGOF is set to the second predetermined opening degree ICMDOF2, and the above-mentioned step 43 is executed, followed by terminating the present process.

On the other hand, if the answer to the question of the step 45 is negative (NO), i.e. if DNEIGOFTHL≤DNEIGOFTH<DNEIGOFTHH holds, the target opening degree ICMDTHIGOF is set to a third predetermined opening degree ICMDOF3 (step 46), and the step 43 is executed, followed by terminating the present process. This third predetermined opening degree ICMDOF3 is larger than the first predetermined opening degree ICMDOFPRE, and is smaller than the second predetermined opening degree ICMDOF2.

Figure 7:
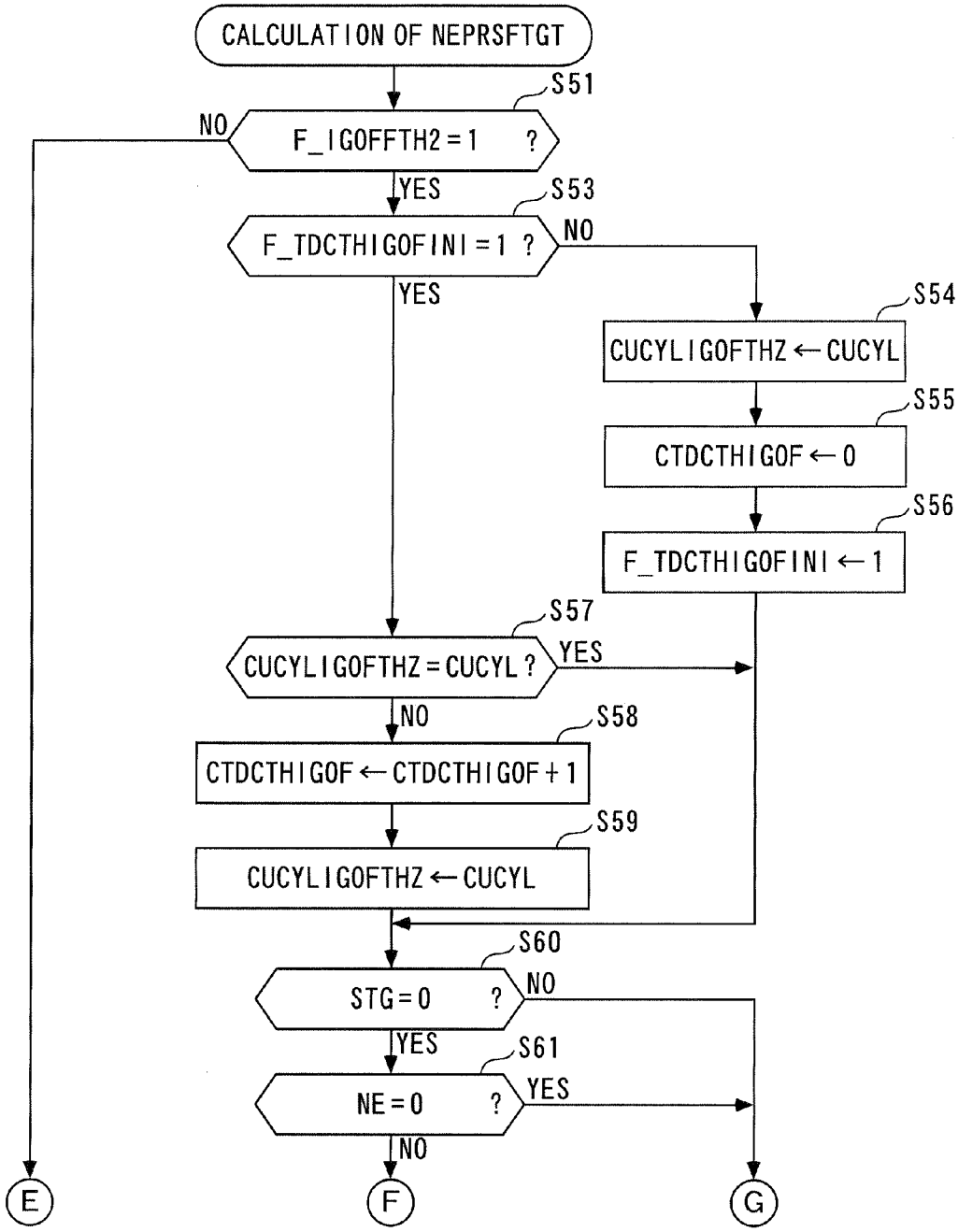
FIG. 7 A flowchart of a process for calculating a final compression stroke rotational speed.
Figure 8:
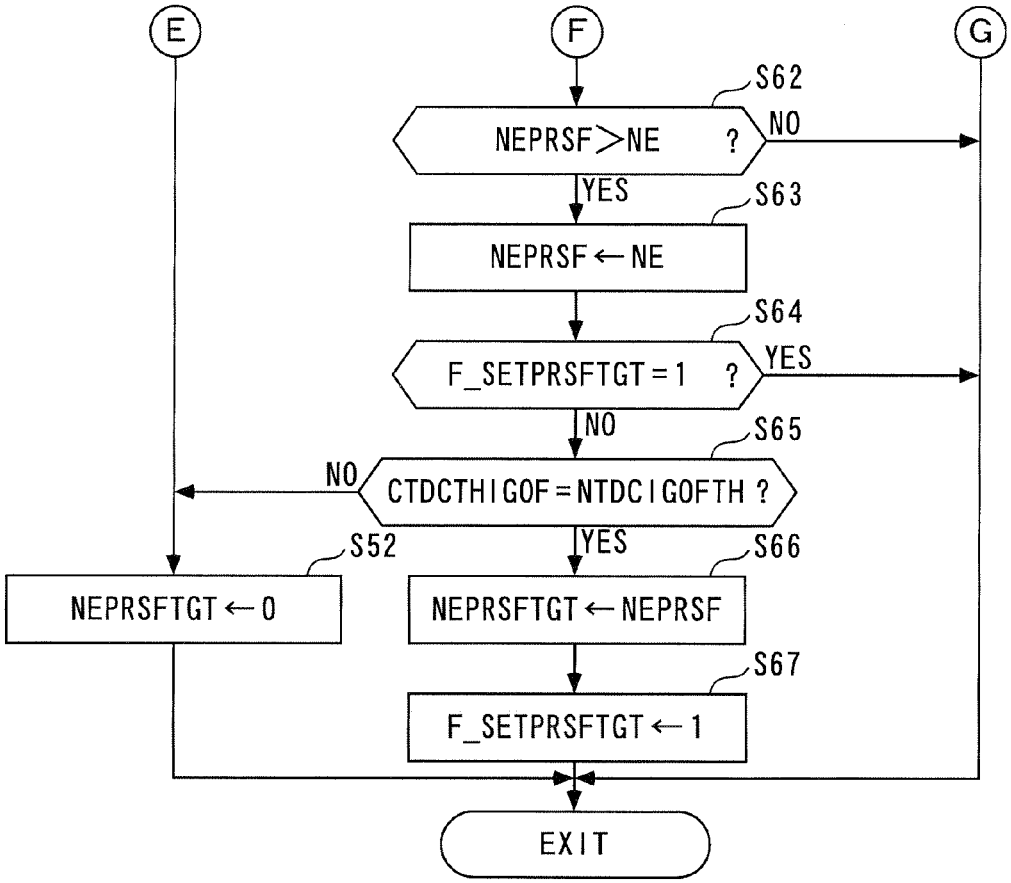
FIG. 8 A flowchart of a remaining part of the FIG. 7 calculation process.

FIGS. 7 and 8 show a process for calculating the final compression stroke rotational speed NEPRSFTGT. In the present process, first, in a step 51, it is determined whether or not the second stage control execution flag F_IGOFFTH2 is equal to 1. If the answer to this question is negative (NO), i.e. if the second stage control is not being executed, the final compression stroke rotational speed NEPRSFTGT is set to 0 (step 52), followed by terminating the present process.

On the other hand, if the answer to the question of the step 51 is affirmative (YES), i.e. if the second stage control is being executed, it is determined in a step 53 whether or not an initialization completion flag F_TDCTHIGOFINI is equal to 1. If the answer to this question is negative (NO), the cylinder number CUCYL assigned at the time is shifted to an immediately preceding value CUCYLIGOFTHZ thereof (step 54). Further, a TDC counter value CTDCTHIGOF for measuring the number of times of occurrence of TDC after the start of the second stage control is reset to 0 (step 55), and to indicate that the above-mentioned initialization has been completed, the initialization completion flag F_TDCTHIGOFINI is set to 1 (step 56). Then, the process proceeds to a step 60, described hereinafter.

On the other hand, if the answer to the question of the step 53 is affirmative (YES), i.e. if the above-mentioned initialization has already been performed, it is determined whether or not the immediately preceding value CUCYLIGOFTHZ of the cylinder number and the cylinder number CUCYL assigned at the time are equal to each other (step 57). If the answer to this question is affirmative (YES), the process proceeds to the step 60, described hereinafter.

On the other hand, if the answer to the question of the step 57 is negative (NO), i.e. if CUCYLIGOFTHZ≠CUCYL holds, it is determined that TDC has occurred, and the TDC counter value CTDCTHIGOF is incremented (step 58). Then, the cylinder number CUCYL assigned at the time is shifted to the immediately preceding value CUCYLIGOFTHZ thereof (step 59), and then the process proceeds to the step 60.

In the step 60, it is determined whether or not the stage number STG is 0, and in a step 61, it is determined whether or not the engine speed NE is equal to 0. If the answer to the question of the step 60 is negative (NO), i.e. if none of the cylinders 3*a* are in the middle stage of the compression stroke, or if the answer to the question of the step 61 is affirmative (YES), i.e. if the engine 3 has been completely stopped, the present process is terminated.

On the other hand, if the answer to the question of the step 60 is affirmative (YES), i.e. if one of the cylinders 3*a* is in the middle stage of the compression stroke, and at the same time if the answer to the question of the step 61 is negative (NO), i.e. if the engine 3 has not been completely stopped, it is determined in a step 62 whether or not a provisional value NEPRSF of the final compression stroke rotational speed is larger than the engine speed NE obtained at the time. If the answer to this question is negative (NO), i.e. if NEPRSF≤NE holds, the present process is terminated.

On the other hand, if the answer to the question of the step 62 is affirmative (YES), i.e. if NEPRSF>NE holds, the engine speed NE is stored as the provisional value NEPRSF of the final compression stroke rotational speed (step 63), and then it is determined in a step 64 whether or not a final compression stroke rotational speed calculation completion flag F_SETPRSFTGT is equal to 1. If the answer to this question is affirmative (YES), i.e. if calculation of the final compression stroke rotational speed NEPRSFTGT has already been completed, the present process is terminated.

On the other hand, if the answer to the question of the step 64 is negative (NO), i.e. if the calculation of the final compression stroke rotational speed NEPRSFTGT has not been completed yet, it is determined whether or not the TDC counter value CTDCTHIGOF is equal to a predetermined value NTDCIGOFTH (STEP 65). This predetermined value NTDCIGOFTH is determined in advance by determining empirically e.g. by experiment how many times of occurrence of TDC after the start of the second stage control will bring about the final compression stroke, and is set to e.g. 3 in the present embodiment.

If the answer to the question of the step 65 is negative (NO), it is judged that the final compression stroke has not been reached, and hence the process proceeds to the step 52, wherein the final compression stroke rotational speed NEPRSFTGT is set to 0, followed by terminating the present process.

On the other hand, if the answer to the question of the step 65 is affirmative (YES), it is determined that the final compression stroke has been reached, and the provisional value NEPRSF stored in the step 63 is calculated as the final compression stroke rotational speed NEPRSFTGT (step 66). Further, the final compression stroke rotational speed calculation completion flag F_SETPRSFTGT is set to 1 (step 67), followed by terminating the present process. In the following stop control, the final compression stroke rotational speed NEPRSFTGT thus calculated is applied to the aforementioned equation (1), and is used for setting the target stop control start rotational speed NEICOFREFX.

Figure 13:
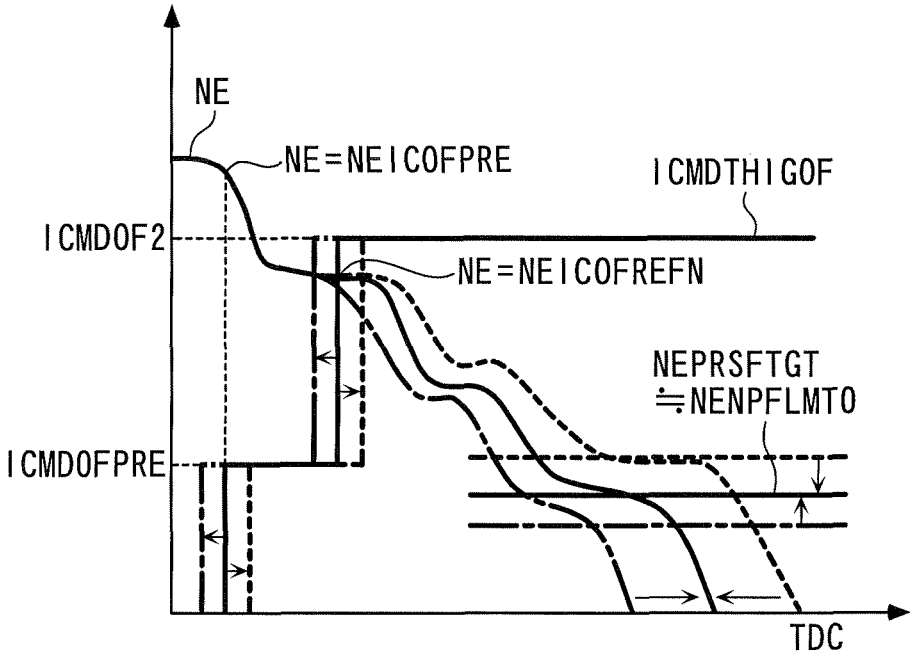
FIG. 13 A view showing an example of an operation obtained by a stop control process of the engine according to the first embodiment together with a comparative example.

FIG. 13 shows examples of operations obtained by the above-described stop control process of the engine 3. In the figure, broken lines indicate a case where the stop characteristic of the piston 3*d* is shifted toward a side where the piston 3*d* is difficult to be stopped, whereas one-dot chain lines inversely indicate a case where the stop characteristic of the piston 3*d* is shifted toward a side where the piston 3*d* is easy to be stopped.

In the case indicated by the broken lines, the rate of reduction of the engine speed NE is small, and hence when the stop control process according to the embodiment is not carried out, the final compression stroke rotational speed NEPRSFTGT becomes larger than the reference value NENPFLMT0. As a consequence, the piston 3*d* stops at TDC after a desired crank angle position, to thereby cause valve overlap. In contrast, when the stop control process is performed, the correlation between the stop control start rotational speed NEIGOFTH and the final compression stroke rotational speed NEPRSFTGT is determined, as described above, and based on the correlation, the basic value NEICOFRRT of the target stop control start rotational speed is set to a smaller value (see FIG. 9), whereby the second stage control is started in later timing. As a consequence, a stop characteristic of the piston 3*d* as indicated by solid lines is obtained such that the final compression stroke rotational speed NEPRSFTGT becomes approximately equal to the reference value NENPFLMT0, and the piston 3*d* stops at the desired crank angle position before TDC, to prevent valve overlap.

On the other hand, in the case indicated by the one-dot chain lines, the rate of reduction of the engine speed NE is large, and hence when the stop control process is not carried out, the final compression stroke rotational speed NEPRSFTGT becomes smaller than the reference value NENPFLMT0. As a consequence, the piston 3*d* stops before the desired crank angle position and valve overlap is not caused. However, when the piston 3*d* becomes even easier to be stopped, there is a fear that in the FIG. 8 process, the piston 3*d* stops before the TDC counter value CTDCTHIGOF reaches the predetermined value NTDCIGOFTH, i.e. at second TDC, causing valve overlap, and the target second stage control opening degree ATHICOFREFX is not learned. In this case, the basic value NEICOFRRT of the target stop control start rotational speed is set to a larger value (see FIG. 9), and the second stage control is started in earlier timing, whereby it is possible to obtain the stop characteristic of the piston 3*d* as indicated by the solid lines, to avoid the above-described inconveniences and stop the piston 3*d* at the desired crank angle position.

As described hereinabove, according to the present embodiment, after the ignition switch 21 is turned off, the target opening degree ICMDTHIGOF of the throttle valve 13*a* is set to 0 to thereby once fully close the throttle valve 13*a* (the step 25 in FIG. 6), and hence it is possible to prevent occurrence of uncomfortable vibration and untoward noise. Further, after that, the first stage control and the second stage control of the throttle valve 13*a* are executed in the mentioned order according to the engine speed NE, and in the second stage control, the target opening degree ICMDTHIGOF is set to the second predetermined opening degree ICMDOF2 or the third predetermined opening degree ICMDOF3 (the steps 42 and 46 in FIG. 6), to thereby control the stop position of the piston 3*d*.

Further, the basic value NEICOFRRT of the target stop control start rotational speed is calculated based on the correlation between the stop control start rotational speed NEIGOFTH and the final compression stroke rotational speed NEPRSFTGT, and the reference value NENPFLMT0 of the final compression stroke rotational speed (the step 5 in FIG. 4), and based on the basic value NEICOFRRT, the target stop control start rotational speed NEICOFREFX is set (the steps 6, 9 and 11 in FIG. 4). This makes it possible to accurately stop the piston 3*d* at the predetermined position free from occurrence of valve overlap while compensating for variation in the stop characteristic of the piston 3*d* and aging thereof.

Further, the current value NEICOFREFX of the target stop control start rotational speed is calculated by averaging calculation using the corrected basic value NEICOFREF of the target stop control start rotational speed and the immediately preceding value NEICOFREFX of the target stop control start rotational speed, and is learned (the step 11 in FIG. 4), so that even in a case where the determination of the above-described correlation and the setting of the basic value NEICOFRRT of the target stop control start rotational speed based on the determined correlation are not properly performed due to a temporary change in the operating conditions of the engine 3, it is possible to properly set the target stop control start rotational speed NEICOFREFX while suppressing adverse influences caused by the above-described improper determination and setting.

Further, as the number of times of learning NENGSTP is larger, the averaging coefficient CICOFREFX is made larger (the step 10 in FIG. 4, FIG. 12), so that it is possible to more properly set the target stop control start rotational speed NEICOFREFX while increasing the weight of immediately preceding value NEICOFREFX of the target stop control start rotational speed having a higher reliability as the learning of the target stop control start rotational speed NEICOFREFX proceeds.

Further, since the target stop control start rotational speed NEICOFREFX is corrected according to the actual atmospheric pressure PA and intake air temperature TA (the steps 26 to 28 in FIG. 5), it is possible to more properly set the target stop control start rotational speed NEICOFREFX to thereby more accurately stop the piston 3*d* at the predetermined position.

Note that although in the above-described first embodiment, the first stage control start rotational speed NEICOFPRE is calculated by adding the predetermined value DNEICOFPRE to the corrected target stop control start rotational speed NEICOFREFN, this value may be further corrected by the atmospheric pressure PA and the intake air temperature TA. Specifically, first, the aforementioned map shown in FIG. 10 is searched according to the atmospheric pressure PA to determine the map value DNEICOFPA, and the map value DNEICOFPA is set as a setting PA correction term dneicofpax1. Further, the aforementioned map shown in FIG. 11 is searched according to the intake air temperature TA to determine the map value DNEICOFTA, and the map value DNEICOFTA is set as a setting TA correction term dneicoftax1. Then, the first stage control start rotational speed NEICOFPRE is calculated using the determined map values by the following equation (6):

$$NEICOFPRE=NEICOFREFN+DNEICOFPRE+dneicofpax1+dneicoftax1 \quad (6)$$

By the setting the maps in FIGS. 10 and 11, the above-mentioned setting PA correction term dneicofpax1 is set to a larger value as the atmospheric pressure PA is higher, and the setting TA correction term dneicoftax1 is set to a larger value as the intake air temperature TA is lower.

Therefore, the first stage control start rotational speed NEICOFPRE is corrected such that it becomes larger as the atmospheric pressure PA is higher and as the intake air temperature TA is lower. This makes it possible to set the first stage control start rotational speed NEICOFPRE in a more fine-grained manner according to the actual atmospheric pressure PA and intake air temperature TA, to more properly control an intake pressure PBA at the start of the second stage control, and therefore it is possible to further enhance the accuracy of the stop control of the piston 3*d*.

Next, a stop control process of the engine 3 according to a second embodiment of the present invention will be described with reference to FIGS. 14 to 20. In the above-described first embodiment, the target stop control start rotational speed NEICOFREFX, which is a target value of the stop control start rotational speed for starting the second stage control, is set and learned. As distinct therefrom, in the present embodiment, a target value of the opening degree of the throttle valve 13*a* in the second stage control is set and learned as the target second stage control opening degree ATHICOFREFX.

Figure 14:
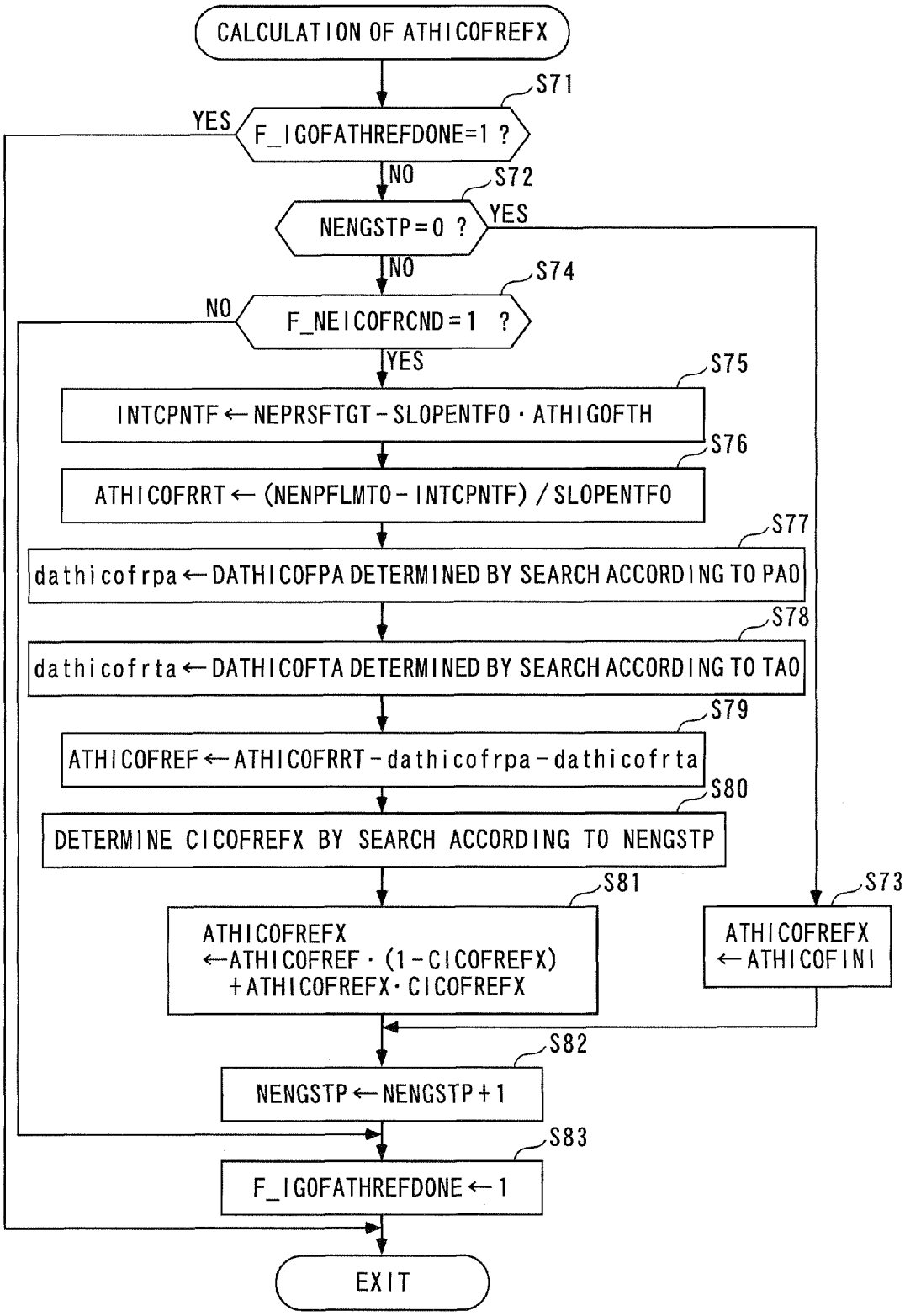
FIG. 14 A flowchart of a process for setting a target second stage control opening degree of a throttle valve according to a second embodiment.

FIG. 14 shows a process for setting this target second stage control opening degree ATHICOFREFX. In the present process, first, in a step 71, it is determined whether or not a target second stage control opening degree-setting completion flag F_IGOFATHREFDONE is equal to 1. If the answer to this question is affirmative (YES), i.e. if the target second stage control opening degree ATHICOFREFX has already been set, the present process is immediately terminated.

On the other hand, if the answer to the question of the step 71 is negative (NO), i.e. if the target second stage control opening degree ATHICOFREFX has not been set yet, it is determined in a step 72 whether or not the number of times of learning NENGSTP is equal to 0. If the answer to this question is affirmative (YES), the target second stage control opening degree ATHICOFREFX is set to a predetermined initial value ATHICOFINI (step 73), and then the process proceeds to a step 82, described hereinafter.

On the other hand, if the answer to the question of the step 72 is negative (NO), it is determined in a step 74 whether or not the aforementioned learning condition satisfied flag F_NEICOFROND is equal to 1. If the answer to this question is negative (NO), i.e. if the learning conditions are not satisfied, the target second stage control opening degree NEICOFREFX is not learned, and then the process proceeds to a step 83, described hereinafter.

On the other hand, if the answer to the question of the step 74 is affirmative (YES), i.e. if the conditions for learning the target second stage control opening degree ATHICOFREFX are satisfied, the process proceeds to a step 75, wherein the intercept INTCPNPF is calculated using the final compression stroke rotational speed NEPRSFTGT obtained during the immediately preceding stop control, the second stage control opening degree ATHIGOFTH, and the predetermined slope SLOPENTF0, by the following equation (7):

$$INTCPNTF=NEPRSFTGT-SLOPENTF0\cdot ATHIGOFTH \quad (7)$$

Figure 17:
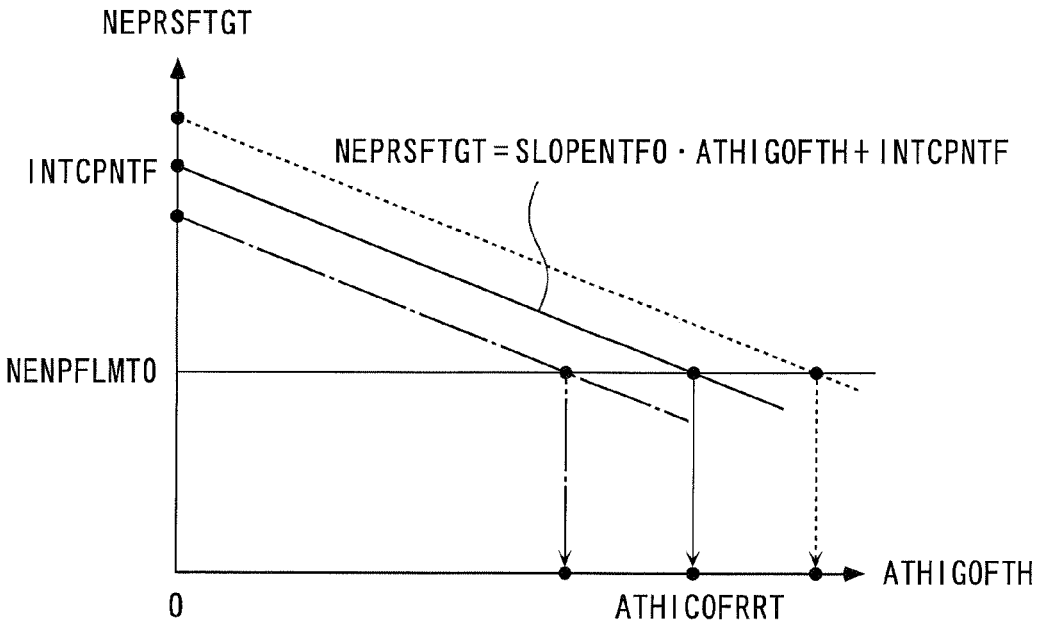
FIG. 17 A view of a relationship between a second stage control opening degree and a final compression stroke rotational speed according to the second embodiment.

This equation (7) is based on preconditions that a correlation as shown in FIG. 17, i.e. a correlation expressed by a linear function having a slope of SLOPENTF0 and an intercept of INTCPNTF holds between the second stage control opening degree ATHIGOFTH and the final compression stroke rotational speed NEPRSFTGT, and the slope SLOPENTF0 is constant if the engine 3 is of the same type. The intercept INTCPNTF is calculated according to the above preconditions, using the second stage control opening degree ATHIGOFTH and the final compression stroke rotational speed NEPRSFTGT, by the equation (7), whereby the correlation between the second stage control opening degree ATHIGOFTH and the final compression stroke rotational speed NEPRSFTGT is determined. Incidentally, as the friction of the piston 3*d* is larger, the final compression stroke rotational speed NEPRSFTGT takes a larger value with respect to a basic value ATHICOFRRT of the same target second stage control opening degree, so that the linear function is offset toward an upper side (as indicated by broken lines in FIG. 17, for example), and the intercept INTCPNTF is calculated to be a larger value. Inversely, as the friction of the piston 3*d* is smaller, the linear function is offset toward a lower side (as indicated by one-dot chain lines in FIG. 17, for example) for the converse reason to the above, and the intercept INTCPNTF is calculated to be a smaller value.

Then, in a step 76, the basic value ATHICOFRRT of the target second stage control opening degree is calculated based on the correlation determined as described above, by using the calculated intercept INTCPNTF and slope SLOPENTF0 and applying the predetermined reference value NENPFLMT0 of the final compression stroke rotational speed to the following equation (8) (see FIG. 17).

$$ATHICOFRRT-(NENPFLMT0-INTCPNTF)/SLOPENTF0 \quad (8)$$

By using the basic value ATHICOFRRT of the target second stage control opening degree calculated by the above-mentioned equation (8), it is possible to stop the piston 3*d* at the predetermined position.

Figure 18:
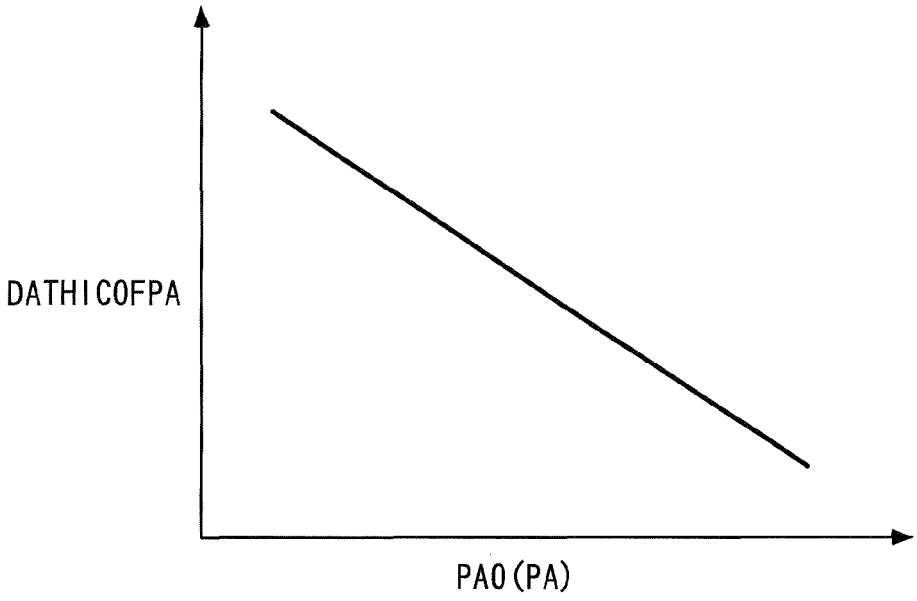
FIG. 18 A map for use in setting a learning PA correction term and a setting PA correction term according to the second embodiment.

Next, in a step 77, a map shown in FIG. 18 is searched according to the atmospheric pressure PA0 detected during the stop control to determine the map value DATHICOFPA, and the map value DATHICOFPA is set as the learning PA correction term dathicofrpa. In this map, the map value DATHICOFPA (=learning PA correction term dathicofrpa) is set to a smaller value as the atmospheric pressure PA0 is higher.

Figure 19:
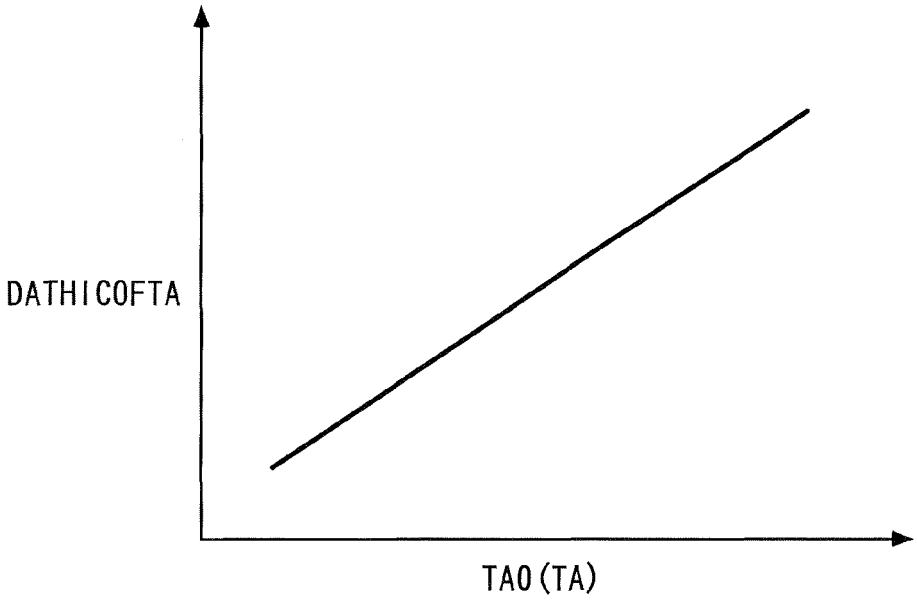
FIG. 19 A map for use in setting a learning TA correction term and a setting TA correction term according to the second embodiment.

Then, in a step 78, a map shown in FIG. 19 is searched according to the intake air temperature TA0 detected during the stop control to determine a map value DATHICOFTA, and the map value DATHICOFTA is set as a learning TA correction term dathicofrta. In this map, the map value DATHICOFTA (=learning TA correction term dathicofrta) is set to a smaller value as the intake air temperature TA0 is lower.

Next, a corrected basic value ATHICOFREF of the target second stage control opening degree is calculated using the basic value ATHICOFRRT of the target second stage control opening degree, the learning PA correction term dathicofrpa, and the learning TA correction term dathicofrta, which are calculated in the steps 76 to 78, by the following equation (9) (step 79)

$$ATHICOFREF=ATHICOFRRT-dathicofrpa-dathicofrta \quad (9)$$

As described hereinabove, since the learning PA correction term dathicofrpa is set to a smaller value as the atmospheric pressure PA0 is higher, the corrected basic value ATHICOFREF of the target second stage control opening degree is corrected to a larger value as the atmospheric pressure PA0 is higher. Further, since the learning TA correction term dathicofrta is set to a smaller value as the intake air temperature TA0 is lower, the corrected basic value ATHICOFREF of the target second stage control opening degree is corrected to a larger value as the intake air temperature TA0 is lower.

Next, in a step 80, the averaging coefficient CICOFREFX is calculated by searching the map shown in FIG. 12 according to the number of times of learning NENGSTP.

Next, in a step 81, a current value ATHICOFREFX of the target second stage control opening degree is calculated using the calculated corrected basic value ATHICOFREF of the target second stage control opening degree, an immediately preceding value ATHICOFREFX of the target second stage control opening degree, and the averaging coefficient CICOFREFX, by the following equation (10):

$$ATHICOFREFX=ATHICOFREF\cdot(1-CICOFREFX)+ATHICOFREFX\cdot CICOFREFX$$

As is clear from the above equation (10), the target second stage control opening degree ATHICOFREFX is calculated as a weighted average value of the corrected basic value ATHICOFRRT of the target second stage control opening degree and the immediately preceding value ATHICOFREFX of the target second stage control opening degree, and the averaging coefficient CICOFREFX is used as a weight coefficient for weighted averaging. Further, the averaging coefficient CICOFREFX is set as described above according to the number of times of learning NENGSTP, and therefore as the number of times of learning NENGSTP is smaller, the degree of reflection of the corrected basic value ATHICOFREF of the target second stage control opening degree becomes larger, whereas as the number of times of learning NENGSTP is larger, the degree of reflection of the immediately preceding value ATHICOFREFX of the target second stage control opening degree becomes larger.

In the step 82 following the step 73 or 81, the number of times of learning NENGSTP is incremented. Further, if the answer to the question of the step 74 is negative (NO), or after the step 82, the proceeds to the step 83, wherein the target second stage control opening degree-setting completion flag F_IGOFATHREFDONE is set to 1, followed by terminating the present process.

Figure 15:
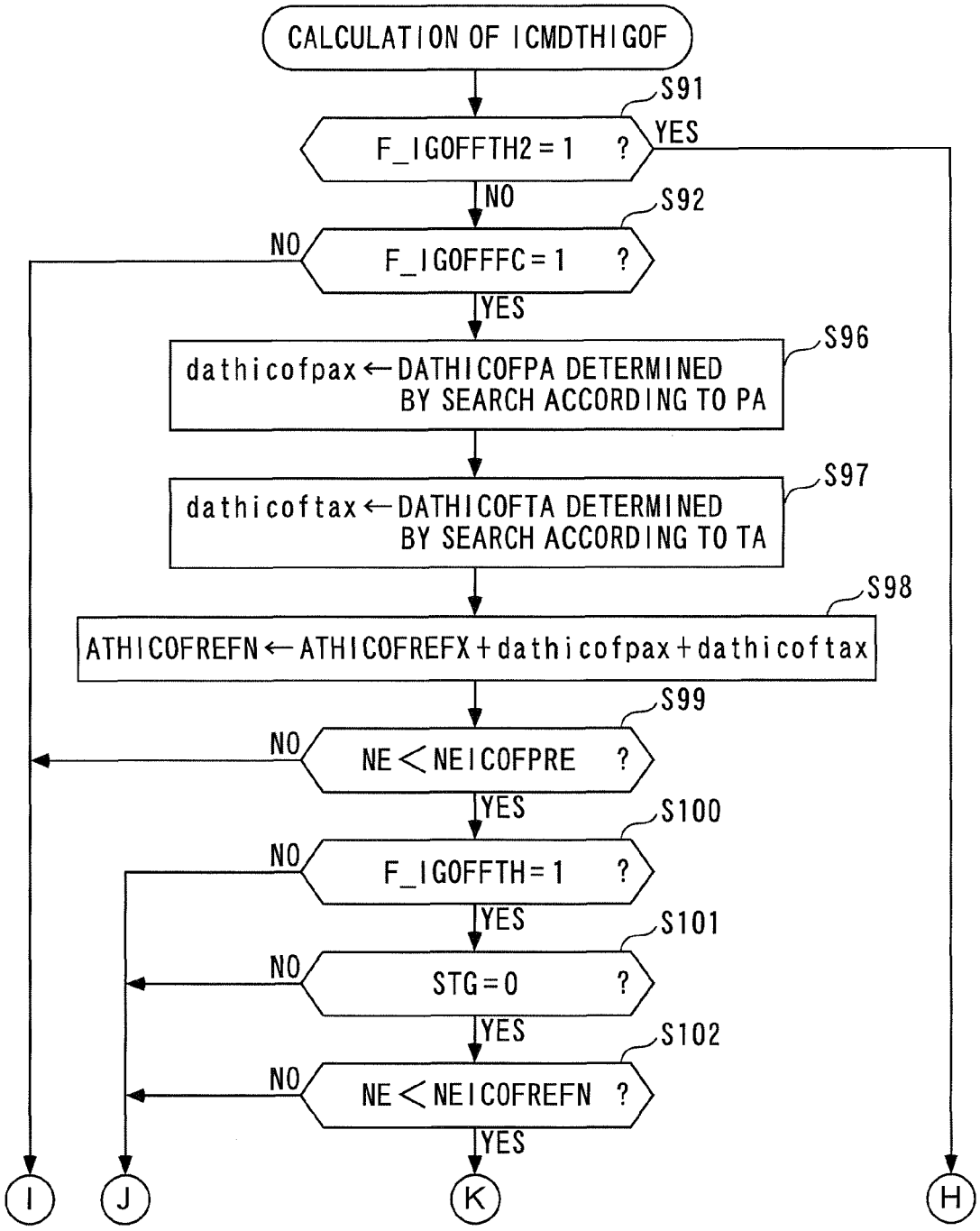
FIG. 15 A flowchart of a process for setting a target opening degree of a throttle valve according to the second embodiment.
Figure 16:
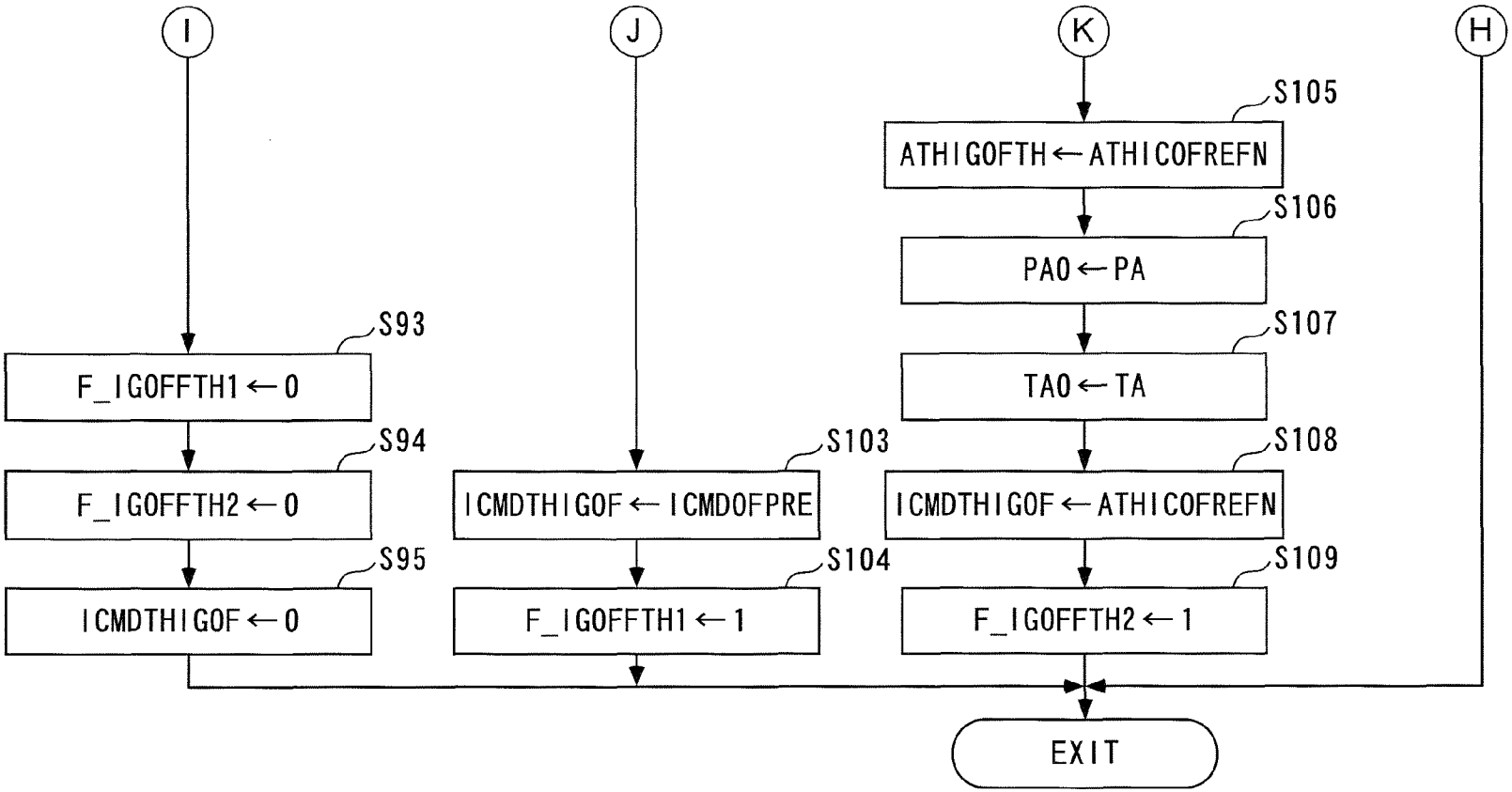
FIG. 16 A flowchart of a remaining part of the FIG. 15 setting process.

FIGS. 15 and 16 show a process for setting the target opening degree ICMDTHIGOF of the throttle valve 13*a*. Similarly to the first embodiment, in this process, after turning off the ignition switch 21, the fully-closing control of the throttle valve 13*a*, the first stage control, and the second stage control are performed in the mentioned order according to the engine speed NE. In the present process, first, in a step 91, it is determined whether or not the second stage control execution flag F_IGOFFTH2 is equal to 1. If the answer to this question is affirmative (YES), i.e. if the second stage control is being executed, the present process is immediately terminated.

On the other hand, if the answer to the question of the step 91 is negative (NO), it is determined in a step 92 whether or not the fuel cut flag F_IGOFFFC is equal to 1. If the answer to this question is negative (NO), the first stage control execution flag F_IGOFFTH1 and the second stage control execution flag F_IGOFFTH2 are set to 0 (steps 93 and 94), respectively, and the target opening degree ICMDTHIGOF is set to 0 (step 95), followed by terminating the present process.

On the other hand, if the answer to the question of the step 92 is affirmative (YES), the above-mentioned map shown in FIG. 18 is searched according to the atmospheric pressure PA currently detected to thereby determine the map value DATHICOFPA, and the map value DATHICOFPA is set as a setting PA correction term dathicofpax (step 96).

Next, in a step 97, the above-mentioned map shown in FIG. 19 is searched according to the intake air temperature TA currently detected to thereby determine the map value DATHICOFTA, and the map value DATHICOFTA is set as a setting TA correction term dathicoftax.

Next, in a step 98, a corrected target second stage control opening degree ATHICOFREFN is calculated using the target second stage control opening degree ATHICOFREFX calculated in the step 81 in FIG. 14, the calculated setting PA correction term dathicofpax and setting TA correction term dathicoftax, by the following equation (11):

$$ATHICOFREFN=ATHICOFREFX+dathicofpax+dathicoftax \quad (11)$$

As the atmospheric pressure PA is lower, the density of intake air is lower and the resistance of intake air to the piston 3*d* is smaller, so that the rate of reduction of the engine speed NE becomes smaller. Further, after the control signal based on the target opening degree ICMDTHIGOF is delivered, there occurs a delay before the opening degree of the throttle valve 13*a* becomes commensurate with the control signal, and a further delay occurs before the intake air amount becomes large enough to be commensurate with the opening degree of the throttle valve 13*a*. Therefore, by correcting the corrected target second stage control opening degree ATHICOFREFN to a larger value as the atmospheric pressure PA is lower, to thereby increase the intake air amount, it is possible to properly avoid the adverse influence of the operation of the throttle valve 13*a* and the delay of intake air, described above.

On the other hand, since the setting TA correction term dathicoftax is set to a larger value as the intake air temperature TA is higher, the corrected target second stage control opening degree ATHICOFREFN is corrected to a larger value as the intake air temperature TA is higher. As the intake air temperature TA is higher, the sliding friction of the piston 3*d* is smaller, and the density of intake air is lower, which reduces the rate of reduction of the engine speed NE. Therefore, by correcting the corrected target second stage control opening degree ATHICOFREFN to a smaller value as the intake air temperature TA is lower to thereby reduce the intake air amount, it is possible to properly avoid the adverse influence of the operation of the throttle valve 13*a* and the delay of intake air.

Then, in a step 99, it is determined whether or not the engine speed NE is smaller than a predetermined first stage control start rotational speed NEICOFPRE (e.g. 550 rpm). If the answer to this question is negative (NO), i.e. if NE≥NEICOFPRE holds, the above-described steps 93 to 95 are executed, followed by terminating the present process.

On the other hand, if the answer to the question of the step 99 is affirmative (YES), i.e. if the engine speed NE is smaller than the first stage control start rotational speed, it is determined whether or not the first stage control execution flag F_IGOFFTH1 is equal to 1 (step 100). If the answer to this question is negative (NO), i.e. if the first stage control has not been executed yet, the target opening degree ICMDTHIGOF is set to the first predetermined opening degree ICMDOFPRE (step 103), and the first stage control execution flag F_IGOFFTH1 is set to 1 (step 104), followed by terminating the present process.

On the other hand, if the answer to the question of the step 99 is affirmative (YES), i.e. if the first stage control is being executed, it is determined whether or not the stage number STG is 0 (step 101). If the answer to this question is negative (NO), the above-described steps 103 and 104 are executed, followed by terminating the present process.

On the other hand, if the answer to the question of the step 101 is affirmative (YES), i.e. if the stage number STG is 0, it is determined whether or not the engine speed NE is smaller than a predetermined stop control start rotational speed NEICOFREFN (e.g. 500 rpm) (step 102). If the answer to this question is negative (NO), i.e. if NEICOFREFN≤NE<NEICOFPRE holds, the above-described steps 103 and 104 are executed to thereby continue the first stage control, followed by terminating the present process.

On the other hand, if the answer to the question of the step 102 is affirmative (YES), i.e. if the stage number STG is 0, and at the same time if the engine speed NE is lower than the stop control start rotational speed NEICOFREFN, the process proceeds to a step 105, wherein the corrected target second stage control opening degree ATHICOFREFN calculated in the step 98 is stored as a second stage control opening degree ATHIGOFTH for the stop control, and the atmospheric pressure PA and the intake air temperature TA, which are currently detected, are stored as an atmospheric pressure PA0 and an intake air temperature TA0 detected for the stop control (steps 106 and 107), respectively. The stored second stage control opening degree ATHIGOFTH is applied to the aforementioned equation (7), and the atmospheric pressure PA0 and the intake air temperature TA0 are used in the FIG. 14 steps 77 and 78, for calculating the learning PA correction term dathicofrpa and the learning TA correction term dathicofrta, respectively.

Next, in a step 108, the target opening degree ICMDTHIGOF is set to the corrected target second stage control opening degree ATHICOFREFN set in the step 98. Further, the second stage control execution flag F_IGOFFTH2 is set to 1 (step 109), followed by terminating the present process.

After that, the final compression stroke rotational speed NEPRSFTGT is calculated in the process shown in FIGS. 7 and 8. In the following stop control, the calculated final compression stroke rotational speed NEPRSFTGT is applied to the aforementioned equation (7), and is used for setting the target second stage control opening degree ATHICOFREFX.

Figure 20:
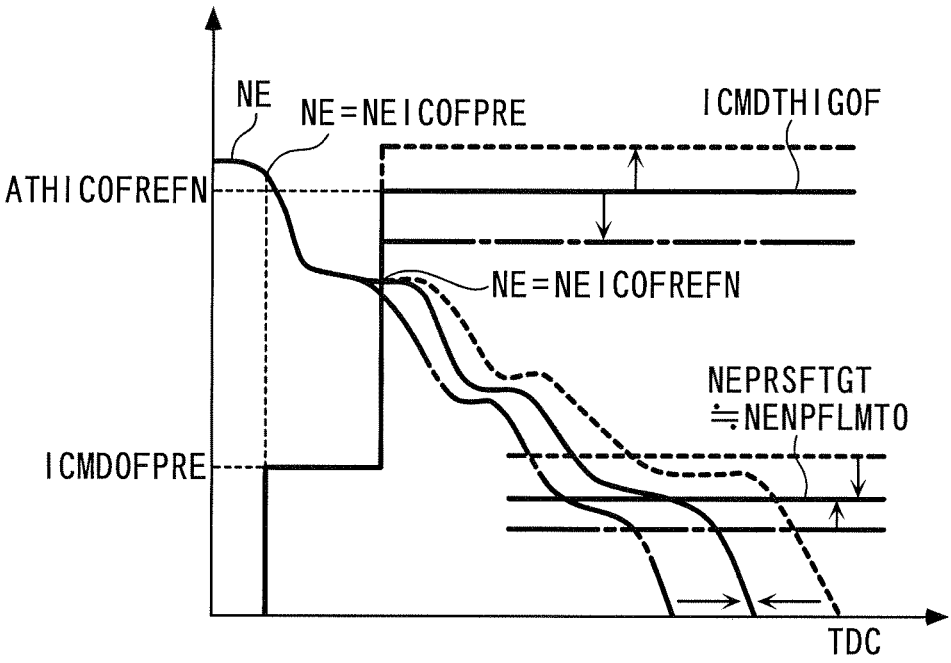
FIG. 20 A view showing an example of an operation obtained by a stop control process of the engine according to the second embodiment together with a comparative example.

FIG. 20 shows examples of operations obtained by the above-described stop control process of the engine 3. In the figure, broken lines indicate a case where the stop characteristic of the piston 3*d* is shifted toward a side where the piston 3*d* is difficult to be stopped, but inversely, one-dot chain lines indicate a case where the stop characteristic of the piston 3*d* is shifted toward a side where the piston 3*d* is easy to be stopped.

In the case indicated by the broken lines, the rate of reduction of the engine speed NE is small, and hence when the stop control process according to the embodiment is not carried out, the final compression stroke rotational speed NEPRSFTGT becomes larger than the reference value NENPFLMT0. As a consequence, the piston 3*d* stops at TDC after a desired crank angle position, to thereby cause valve overlap. In contrast, when the stop control process is performed, the correlation between the second stage control opening degree ATHIGOFTH and the final compression stroke rotational speed NEPRSFTGT is determined, as described above, and based on the correlation, the basic value ATHICOFRRT of the target second stage control opening degree is set to a larger value (see FIG. 17), whereby the target opening degree ICMDTHIGOF for the second stage control is set to a larger value. As a consequence, a stop characteristic of the piston 3*d* as indicated by solid lines is obtained such that the final compression stroke rotational speed NEPRSFTGT becomes approximately equal to the reference value NENPFLMT0, and the piston 3*d* stops at the desired crank angle position before TDC, to prevent valve overlap.

On the other hand, in the case indicated by the one-dot chain lines, the rate of reduction of the engine speed NE is large, and hence when the stop control process is not carried out, the final compression stroke rotational speed NEPRSFTGT becomes smaller than the reference value NENPFLMT0. As a consequence, the piston 3*d* stops before the desired crank angle position and valve overlap is not caused. However, when the piston 3*d* becomes even easier to be stopped, there is a fear that in the FIG. 8 process, the piston 3*d* stops at a second TDC to cause valve overlap, and the target second stage control opening degree ATHICOFREFX is not learned. In this case, the basic value ATHICOFRRT of the target second stage control opening degree is set to a smaller value (see FIG. 17), and the target opening degree ICMDTHIGOF for the second stage control is set to a smaller value, whereby it is possible to obtain the stop characteristic of the piston 3*d* as indicated by the solid lines, to avoid the above-described inconveniences and stop the piston 3*d* at the desired crank angle position.

As described hereinabove, according to the present embodiment, after the ignition switch 21 is turned off, the target opening degree ICMDTHIGOF is set to 0 to thereby once fully close the throttle valve 13*a* (the step 95 in FIG. 16), and hence it is possible to prevent occurrence of uncomfortable vibration and untoward noise. Further, after that, the first stage control and the second stage control of the throttle valve 13*a* are executed in the mentioned order according to the engine speed NE, and in the second stage control, the target opening degree ICMDTHIGOF is set to the corrected target second stage control opening degree ATHICOFREFN (the step 108 in FIG. 16), to thereby control the stop position of the piston 3*d*.

Further, the basic value ATHICOFRRT of the target second stage control opening degree is calculated based on the correlation between the second stage control opening degree ATHIGOFTH and the final compression stroke rotational speed NEPRSFTGT, and the reference value NENPFLMT0 of the final compression stroke rotational speed (the step 76 in FIG. 14), and based on the basic value ATHICOFRRT, the target second stage control opening degree ATHICOFREFX is set (the steps 79 and 81 in FIG. 14). Therefore, it is possible to accurately stop the piston 3*d* at the predetermined position free from occurrence of valve overlap while compensating for variation in the stop characteristic of the piston 3*d* and aging thereof.

Further, the current value ATHICOFREFX of the target second stage control opening degree is calculated by averaging calculation using the corrected basic value ATHICOFREF of the target second stage control opening degree and the immediately preceding value ATHICOFREFX of the target second stage control opening degree, and is learned (the step 81 in FIG. 14), so that even in a case where the determination of the above-described correlation and the setting of the basic value ATHICOFRRT of the target second stage control opening degree based on the determined correlation are not properly performed due to a temporary change in the operating conditions of the engine 3, it is possible to properly set the target second stage control opening degree ATHICOFREFX while suppressing adverse influences caused by the above-described improper determination and setting.

Further, as the number of times of learning NENGSTP is larger, the averaging coefficient CICOFREFX is made larger (the step 80 in FIG. 14, FIG. 12), so that it is possible to more properly set the target second stage control opening degree ATHICOFREFX while increasing the weight of immediately preceding value ATHICOFREFX of the target second stage control opening degree having a higher reliability, as the learning of the target second stage control opening degree ATHICOFREFX proceeds.

Further, since the target second stage control opening degree ATHICOFREFX is corrected according to the actual atmospheric pressure PA and intake air temperature TA (the steps 96 to 98 in FIG. 15), it is possible to more properly set the target second stage control opening degree ATHICOFREFX to more accurately stop the piston 3*d* at the predetermined position.

Figure 21:
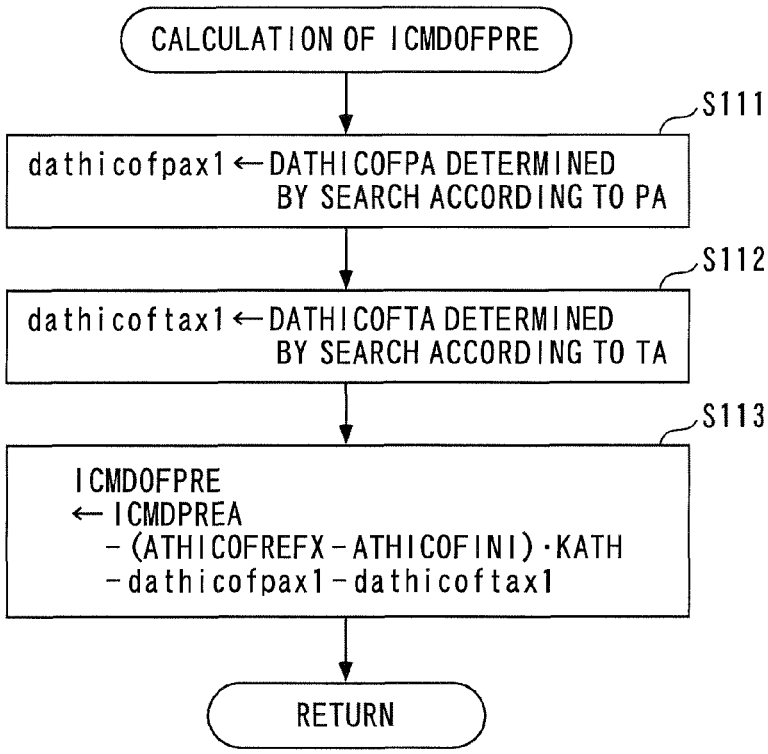
FIG. 21 A flowchart of a process for calculating a first predetermined opening degree according to a variation of the second embodiment.

Next, a variation of the above-described second embodiment will be described with reference to FIG. 21. In the second embodiment, the first predetermined opening degree ICMDOFPRE used in the step 103 in FIG. 16 is a fixed value. As distinct therefrom, in this variation, the first predetermined opening degree ICMDOFPRE is calculated according to the target second stage control opening degree ATHICOFREFX.

In the present embodiment, first, in a step 111, the above-mentioned map shown in FIG. 18 is searched according to the atmospheric pressure PA to determine the map value DATHICOFPA, whereby the map value DATHICOFPA is set as a setting PA correction term dathicofpax1 for the first predetermined opening degree.

Next, in a step 112, the above-mentioned map shown in FIG. 19 is searched according to the intake air temperature TA to thereby determine the map value DATHICOFTA, and the map value DATHICOFTA is set as a setting TA correction term dathicoftax1 for the first predetermined opening degree.

Then, in a step 113, the first predetermined opening degree ICMDOFPRE is calculated using a predetermined basic value ICMDPREA, the target second stage control opening degree ATHICOFREFX, the initial value ATHICOFINI, a predetermined coefficient KATH, and the setting PA correction term dathicofpax1 and setting TA correction term dathicoftax1 calculated as described above, by the following equation (12), followed by terminating the present process.

$$ICMDOFPRE=ICMDPREA-(ATHICOFREFX-ATHICOFINI)\cdot KATH-dathicofpax1-dathicoftax1 \quad (12)$$

Figure 27:
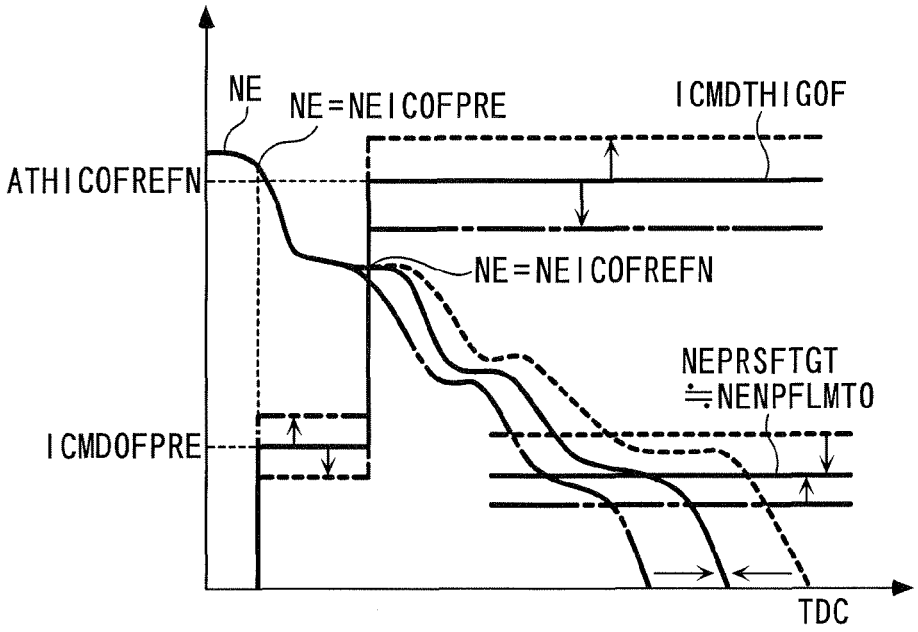
FIG. 27 A view showing an example of an operation obtained by a stop control process of the engine according to the variation of the second embodiment.

As is clear from the above equation (12), the first predetermined opening degree ICMDOFPRE is set to a smaller value as the target second stage control opening degree ATHICOFREFX is larger. The fact that the target second stage control opening degree ATHICOFREFX is set to a large value by the learning of the target second stage control opening degree ATHICOFREFX described above represents a state where a time period required for the first stage control is liable to be long since the friction of the piston 3*d* is small to make the piston 3*d* difficult to be stopped. Therefore, the first predetermined opening degree ICMDOFPRE is set to a smaller value as the target second stage control opening degree ATHICOFREFX is larger (see FIG. 27), whereby the intake air amount is reduced to suppress the rate of rise of the intake pressure PBA during the first stage control. This makes it possible to properly control the intake pressure PBA at the start of the second stage control, irrespective of the target second stage control opening degree ATHICOFREFX.

Further, as the atmospheric pressure PA is lower and as the intake air temperature TA is higher, the piston 3*d* becomes more difficult to be stopped. On the other hand, by setting the maps in FIGS. 18 and 19, in the equation (12), the setting PA correction term dathicofpax1 is set to a larger value as the atmospheric pressure PA is lower, and the setting TA correction term dathicoftax1 is set to a larger value as the intake air temperature TA is higher.

Therefore, the first predetermined opening degree ICMDOFPRE is corrected such that it becomes smaller as the atmospheric pressure PA is lower and as the intake air temperature TA is higher. This makes it possible to set the first predetermined opening degree ICMDOFPRE in a more fine-grained manner according to the actual atmospheric pressure PA and intake air temperature TA, to more properly control the intake pressure PBA at the start of the second stage control, and therefore it is possible to further enhance the accuracy of the stop control of the piston 3*d*.

Figure 22:
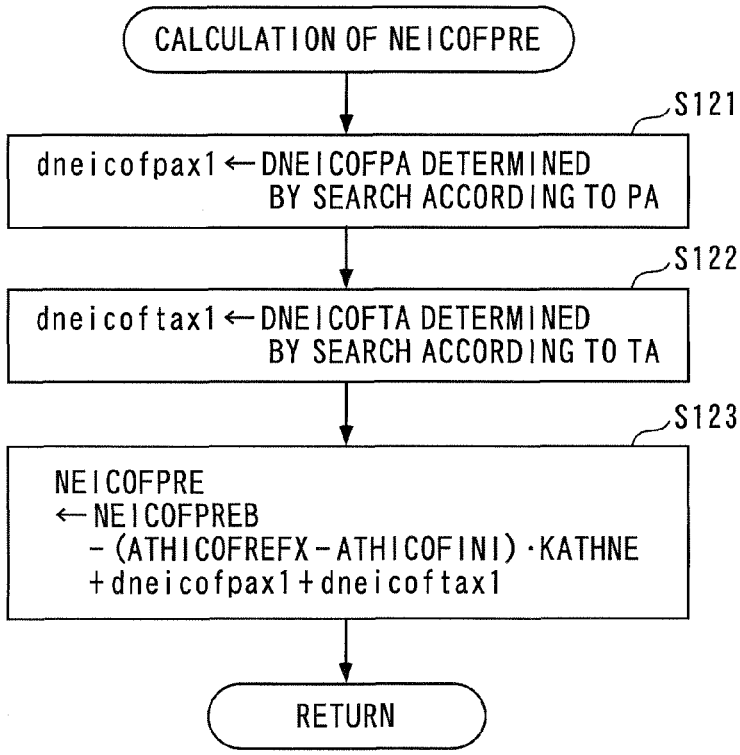
FIG. 22 A flowchart of a process for calculating a first stage control start rotational speed according to another variation of the second embodiment.
Figure 23:
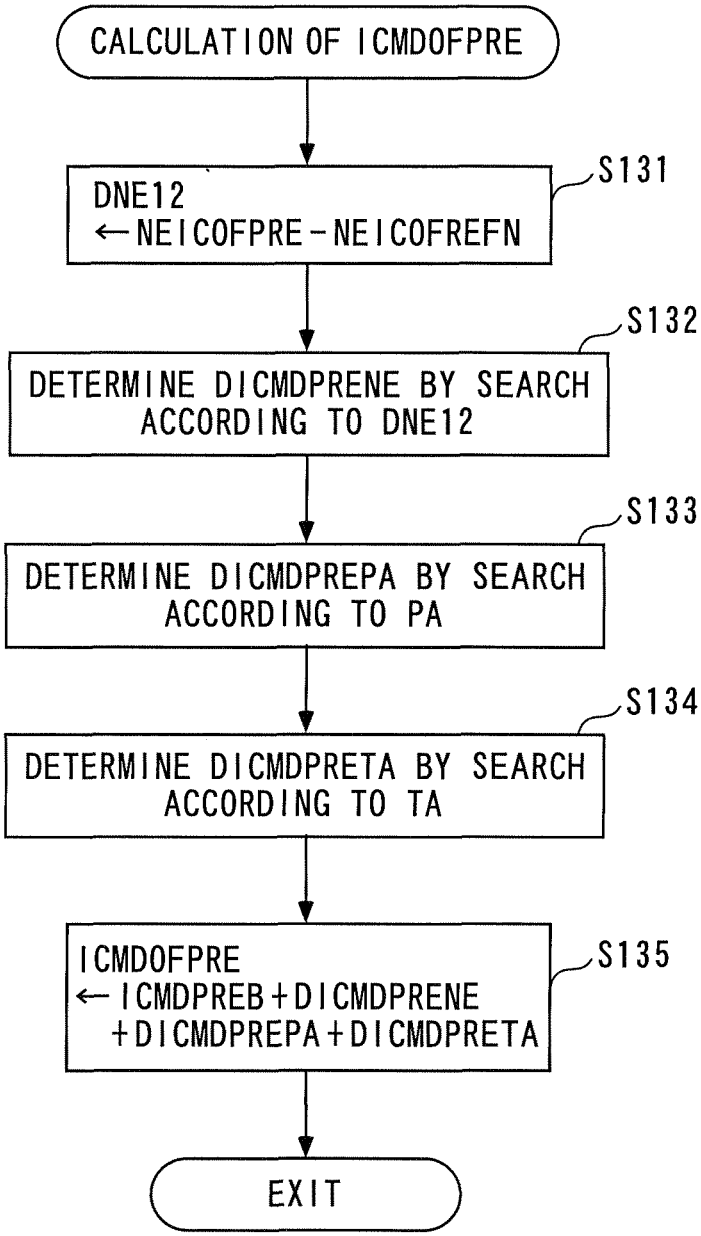
FIG. 23 A flowchart of a process for calculating a first predetermined opening degree according to a variation of the first embodiment.

Next, another variation of the second embodiment will be described with reference to FIG. 22. In the second embodiment, the first stage control start rotational speed NEICOFPRE used in the step 99 in FIG. 15 is a fixed value. As distinct therefrom, in this variation, the first stage control start rotational speed NEICOFPRE is calculated according to the target second stage control opening degree ATHICOFREFX.

In the present embodiment, first, in a step 121, the above-mentioned map shown in FIG. 10 is searched according to the atmospheric pressure PA to thereby determine the map value DNEICOFPA, and the map value DNEICOFPA is set as a setting PA correction term dneicofpax1 for the first stage control start rotational speed.

Next, in a step 122, the above-mentioned map shown in FIG. 11 is searched according to the intake air temperature TA to determine the map value DNEICOFPA, whereby the map value DNEICOFPA is set as a setting TA correction term dneicoftax1 for the first stage control start rotational speed.

Next, in a step 123, the first stage control start rotational speed NEICOFPRE is calculated using a predetermined basic value NEICPREB, the target second stage control opening degree ATHICOFREFX, the initial value ATHICOFINI, and a predetermined coefficient KATHNE, as well as the setting PA correction term dneicofpax1 and setting TA correction term dneicoftax1 calculated as described above, by the following equation (13):

$$NEICOFPRE=NEICPREB-(ATHICOFREFX-ATHICOFINI)\cdot KATHNE+dneicofpax1+dneicoftax1 \quad (13)$$

followed by terminating the present process.

Figure 28:
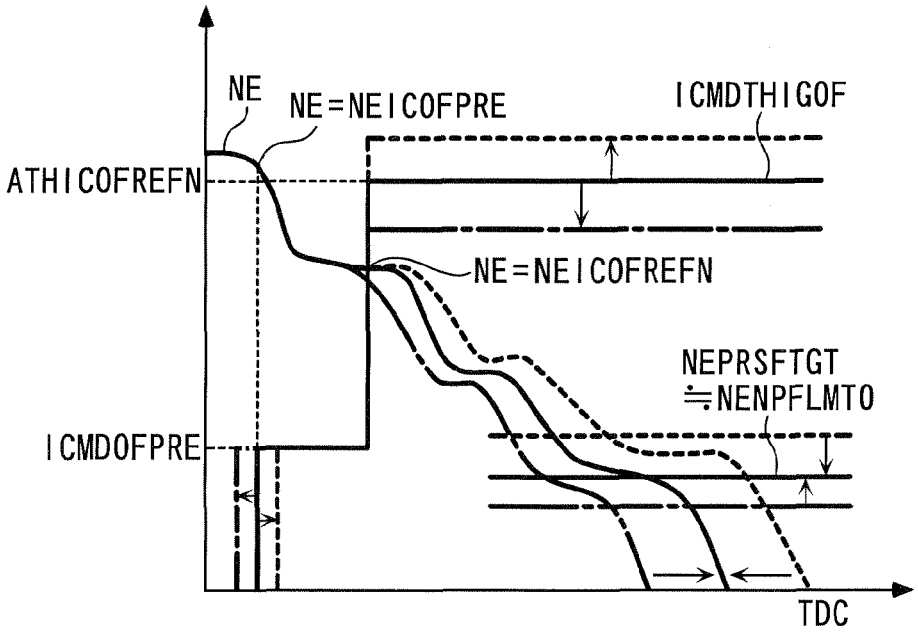
FIG. 28 A view showing an example of an operation obtained by a stop control process of the engine according to the other variation of the second embodiment.

As is clear from the above equation (13), the first stage control start rotational speed NEICOFPRE is set to a smaller value as the target second stage control opening degree ATHICOFREFX is larger. The fact that the target second stage control opening degree ATHICOFREFX is set to a large value by the learning of the target second stage control opening degree ATHICOFREFX described above represents a state where the time period required for the first stage control is liable to be long since the friction of the piston 3*d* is small to make the piston 3*d* difficult to be stopped. Therefore, the first stage control start rotational speed NEICOFPRE is set to a smaller value as the target second stage control opening degree ATHICOFREFX is larger (see FIG. 28), whereby the first stage control is started in later timing. As a consequence, it is possible to properly control the intake pressure PBA at the start of the second stage control irrespective of the target second stage control opening degree ATHICOFREFX.

Further, as the atmospheric pressure PA is lower and as the intake air temperature TA is higher, the piston 3*d* becomes more difficult to be stopped. On the other hand, by setting the maps in FIGS. 10 and 11, in the equation (13), the setting PA correction term dneicofpax1 is set to a smaller value as the atmospheric pressure PA is lower and the setting TA correction term dneicoftax1 is set to a smaller value as the intake air temperature TA is higher.

Therefore, the first stage control start rotational speed NEICOFPRE is corrected such that it becomes smaller as the atmospheric pressure PA is lower and as the intake air temperature TA is higher. This makes it possible to set the first stage control start rotational speed NEICOFPRE in a more fine-grained manner according to the actual atmospheric pressure PA and intake air temperature TA, to thereby more properly control the intake pressure PBA at the start of the second stage control. Therefore, it is possible to further enhance the accuracy of the stop control of the piston 3*d*.

Next, a variation of the above-described first embodiment will be described with reference to FIGS. 23 to 26. In the first embodiment, the first stage control start rotational speed NEICOFPRE is calculated according to the corrected target stop control start rotational speed NEICOFREFN. As distinct therefrom, in this variation, the first stage control start rotational speed NEICOFPRE is set to a fixed value, and the first predetermined opening degree ICMDOFPRE is calculated according to the corrected target stop control start rotational speed NEICOFREFN.

In the present process, first, in a step 131, the difference between the predetermined first stage control start rotational speed NEICOFPRE and the corrected target stop control start rotational speed NEICOFREFN is calculated as a rotational speed difference DNE12.

Figure 24:
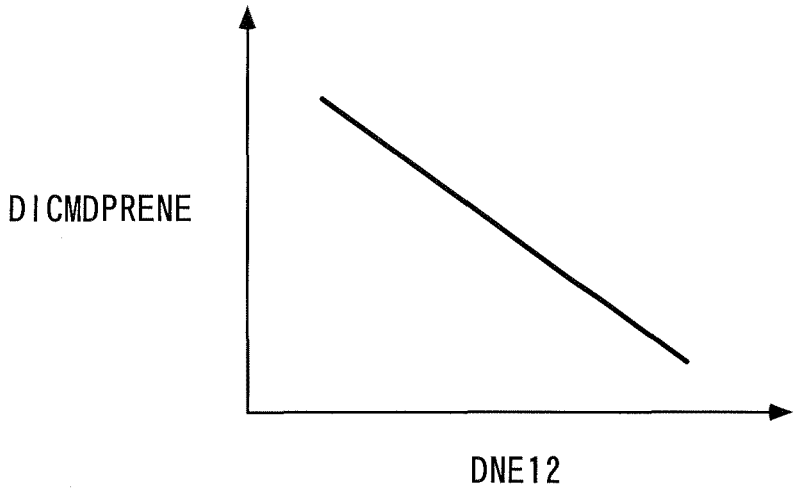
FIG. 24 A map for use in setting an NE correction term used in the FIG. 23 calculation process.

Next, an NE correction term DICMDPRENE is calculated by searching a map shown in FIG. 24 according to the calculated rotational speed difference DNE12 (step 132). In this map, the NE correction term DICMDPRENE is set to a larger value as the rotational speed difference DNE12 is smaller.

Figure 25:
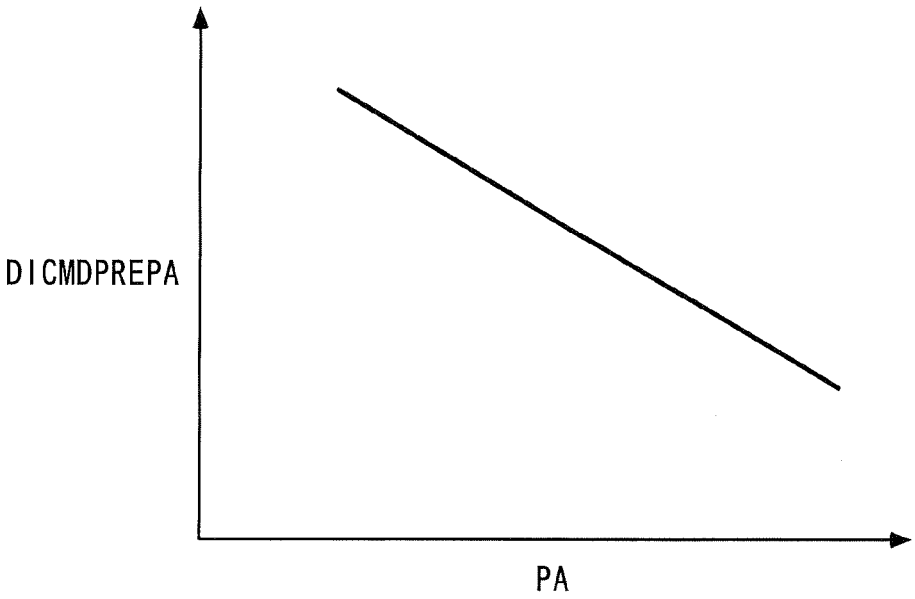
FIG. 25 A map for use in setting a PA correction term used in the FIG. 23 calculation process.

Next, a PA correction term DICMDPREPA is calculated by searching a map shown in FIG. 25 according to the atmospheric pressure PA (step 133). In this map, the PA correction term DICMDPREPA is set to a larger value as the atmospheric pressure PA is lower.

Figure 26:
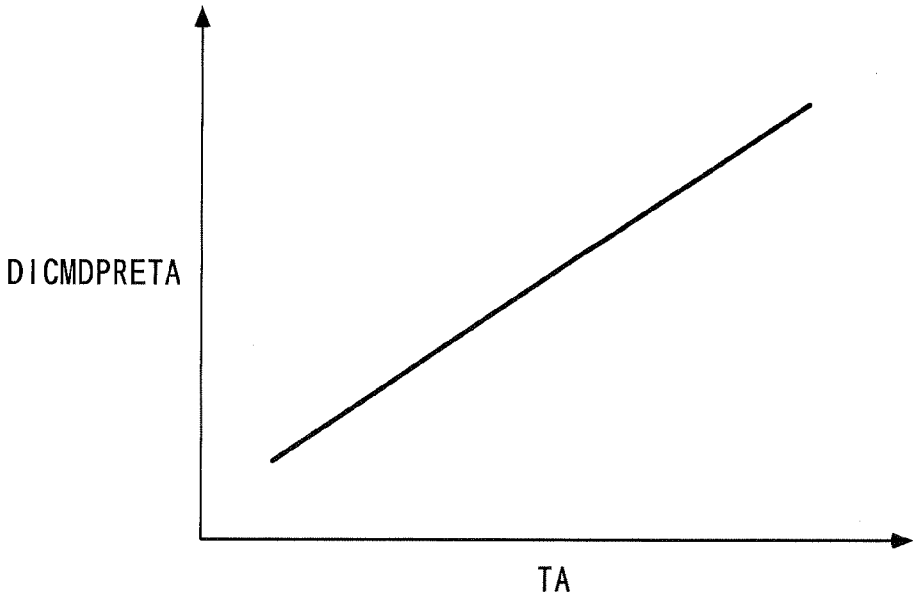
FIG. 26 A map for use in setting a TA correction term used in the FIG. 23 calculation process.

Then, a TA correction term DICMDPRETA is calculated by searching a map shown in FIG. 26 according to the intake air temperature TA (step 134). In this map, the TA correction term DICMDPRETA is set to a larger value as the intake air temperature TA is higher.

Next, the first predetermined opening degree ICMDOFPRE is calculated by adding the NE correction term DICMDPRENE, the PA correction term DICMDPREPA, and the TA correction term DICMDPRETA, which are calculated in the steps 132 to 134, to a basic value ICMDPREB (step 135), by the following equation (14), followed by terminating the present process.

$$ICMDOFPRE=ICMDPREB+DICMDPRENE+DICMDPREPA+DICMDPRETA \quad (14)$$

Figure 29:
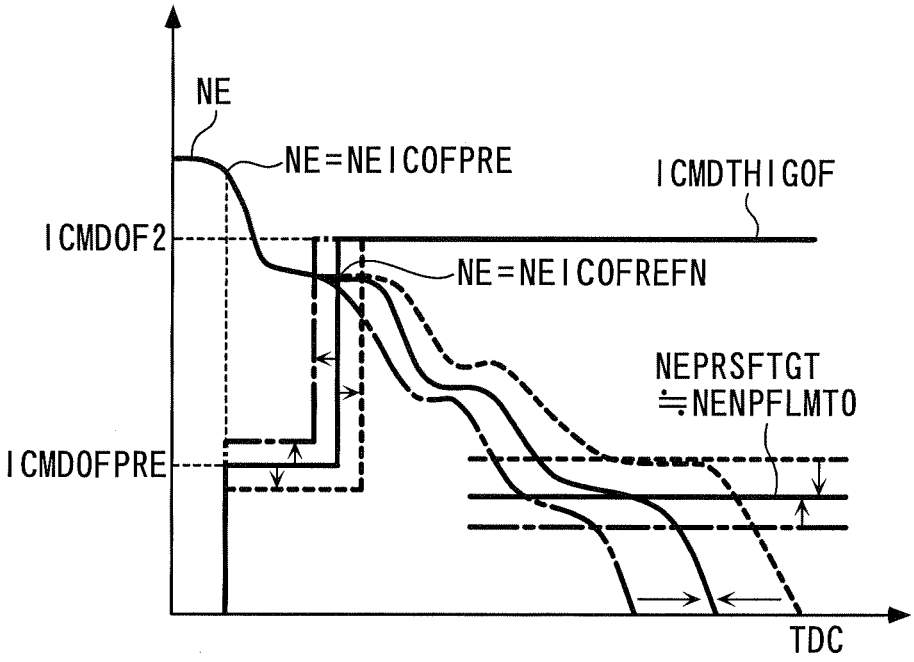
FIG. 29 A view showing an example of an operation obtained by a stop control process of the engine according to the variation of the first embodiment.

As is clear from the above equation (14), the first predetermined opening degree ICMDOFPRE is set to a smaller value as the NE correction term DICMDPRENE is smaller. The fact that the NE correction term DICMDPRENE is set to a small value by the setting of the map shown in FIG. 24 represents that the corrected target stop control start rotational speed NEICOFREFN is set to a large value, and the fact that the corrected target stop control start rotational speed NEICOFREFN is set to a large value represents a state where the time period required for the first stage control is liable to be short since the friction of the piston 3*d* is large to make the piston 3*d* easy to be stopped. Therefore, the first predetermined opening degree ICMDOFPRE is set to a larger value as the corrected target stop control start rotational speed NEICOFREFN is higher (see FIG. 29), whereby the intake air amount is increased to increase the rate of rise of the intake pressure PBA during the first stage control. This makes it possible to properly control the intake pressure PBA at the start of the second stage control, irrespective of the corrected target stop control start rotational speed NEICOFREFN.

Further, as the atmospheric pressure PA is lower and as the intake air temperature TA is higher, the piston 3*d* becomes more difficult to be stopped. On the other hand, by setting the maps in FIGS. 25 and 26, in the equation (14), the PA correction term DICMDPREPA is set to a larger value as the atmospheric pressure PA is lower, and the TA correction term DICMDPRETA is set to a larger value as the intake air temperature TA is higher.

Therefore, the first predetermined opening degree ICMDOFPRE is corrected such that it becomes larger as the atmospheric pressure PA is lower and as the intake air temperature TA is higher. This makes it possible to set the first predetermined opening degree ICMDOFPRE in a more fine-grained manner according to the actual atmospheric pressure PA and intake air temperature TA, to more properly control the intake pressure PBA at the start of the second stage control, and therefore it is possible to further enhance the accuracy of the stop control of the piston 3*d*.

Note that the present invention is by no means limited to the embodiments described above, but can be practiced in various forms. For example, although in the above-described embodiments, the throttle valve 13*a* is used as the intake air amount-adjusting valve for adjusting the intake air amount during stoppage of the engine 3, in place of the throttle valve 13*a*, there may be used intake valves the lift of which can be changed by a variable intake lift mechanism.

Further, although in the above-described embodiments, during stoppage of the engine 3, the first stage control is executed prior to the second stage control of the throttle valve 13*a*, the first stage control may be omitted.

Further, although in the above-described embodiments, linear functions are used as models representing the correlation between the stop control start rotational speed NEIGOFTH or the second stage control opening degree ATHIGOFTH and the final compression stroke rotational speed NEPRSFTGT, this is not limitative, but there may be used other suitable functions, equations, maps, or the like.

Further, although in the above-described embodiments, the correction of the target stop control start rotational speed NEICOFREFX or the target second stage control opening degree ATHICOFREFX is performed according to the atmospheric pressure PA and the intake air temperature TA, the correction may be performed according to a parameter indicative of the temperature of the engine 3, such as the engine coolant temperature TW, in addition to or in place of the atmospheric pressure PA and the intake air temperature TA. In this case, as the engine coolant temperature TW is lower, the sliding friction of the piston 3*d* is larger, and hence the target stop control start rotational speed NEICOFREFX is corrected to a larger value, and the target second stage control opening degree ATHICOFREFX is corrected to a smaller value.

Further, in the above-described embodiments, when the ignition switch 21 is turned off, judging that a command for stopping the engine 3 is issued, the stop control is executed, but in a case where an idle stop is executed in which the engine 3 is automatically stopped when predetermined stop conditions are satisfied, the stop control may be executed after satisfaction of the stop conditions.

Further, although in the above-described embodiments, the engine speed NE, which is obtained during the compression stroke when TDC has occurred a predetermined number of times after the start of the second stage control, is calculated as the final compression stroke rotational speed NEPRSFTGT, the engine speed NE may be calculated and stored every compression stroke, and an engine speed NE stored immediately before stoppage of the engine 3 during the compression stroke may be set as the final compression stroke rotational speed NEPRSFTGT.

Further, although in the above-described embodiments, the final compression stroke rotational speed NEPRSFTGT corresponds to the engine speed NE in the middle stage of the final compression stroke, it is possible to set the final compression stroke rotational speed NEPRSFTGT as an engine speed NE in a desired timing between the start and end of the final compression stroke. In this case, as the timing is closer to the start of the final compression stroke, a time period required before the engine 3 stops becomes longer, and hence the reference value NENPFLMT0 is set to a larger value.

Furthermore, although in the above-described embodiment, the present invention is applied to the gasoline engine installed on a vehicle, this is not limitative, but it can be applied to various engines other than the gasoline engine, e.g. a diesel engine, and further, it can be applied to engines other than the engines for a vehicle, e.g. engines for ship propulsion machines, such as an outboard motor having a vertically-disposed crankshaft. Further, it is possible to change details of the construction of the embodiment within the spirit and scope of the present invention.

INDUSTRIAL APPLICABILITY

As described heretofore, the stop control system according to the present invention is useful in accurately stopping the piston at a predetermined position while compensating for variation in the stop characteristic of the piston and aging thereof.

REFERENCE SIGNS LIST

1 stop control system for internal combustion engine
2 ECU (intake air amount control means, final compression stroke rotational speed-obtaining means, correlation determining means, target stop control start rotational speed-setting means, basic value-calculating means, averaging calculation means, target stop control start rotational speed-correcting means, first stage intake air amount control means, first stage control start rotational speed-setting means, first predetermined opening degree-setting means, target opening degree-setting means, target opening degree-correcting means)
3 engine (internal combustion engine)
3*d* piston
13*a* throttle valve (intake air amount-adjusting valve)
13*b* TH actuator (intake air amount control means)
22 intake air temperature sensor (detection means)
23 atmospheric pressure sensor (detection means)
24 crank angle sensor (rotational speed-detecting means, final compression stroke rotational speed-obtaining means)
26 engine coolant temperature sensor (detection means)
NE engine speed (rotational speed of internal combustion engine)
PA atmospheric pressure
TA intake air temperature (temperature of intake air)
TW engine coolant temperature (temperature of internal combustion engine)
NEIGOFTH stop control start rotational speed
NEICOFRRT basic value of target stop control start rotational speed
NEICOFREFX target stop control start rotational speed
NEICOFREFN corrected target stop control start rotational speed (stop control start rotational speed)
NEPRSFTGT final compression stroke rotational speed
NENPFLMT0 reference value of final compression stroke rotational speed (predetermined final compression stroke rotational speed)
CICOFREFX averaging coefficient (degree of averaging)
NENGSTP number of times of learning (number of times of averaging calculation)
NEICOFPRE first stage control start rotational speed
ICMDOFPRE first predetermined opening degree
ICMDTHIGOF target opening degree (opening degree of intake air amount-adjusting valve)
ATHIGOFTH second stage control opening degree (opening degree of intake air amount-adjusting valve)
ATHICOFRRT basic value of target second stage control opening degree (basic value of target opening degree)

ATHICOFREFX target second stage control opening degree (target opening degree)

The invention claimed is:

1. A stop control system for an internal combustion engine, which controls a stop position of a piston of the engine to a predetermined position during stoppage of the engine by controlling an intake air amount, comprising:

an intake air amount-adjusting valve for adjusting the intake air amount;

rotational speed-detecting means for detecting a rotational speed of the engine;

intake air amount control means for controlling said intake air amount-adjusting valve toward a closed side when a command for stopping the engine is issued, and thereafter when the detected rotational speed of the engine becomes lower than a stop control start rotational speed, controlling said intake air amount-adjusting valve toward an open side;

final compression stroke rotational speed-obtaining means for obtaining the rotational speed of the engine in a final compression stroke immediately before the engine is stopped, as a final compression stroke rotational speed;

correlation determining means for determining a correlation between the stop control start rotational speed and the final compression stroke rotational speed, based on the stop control start rotational speed and the final compression stroke rotational speed obtained when said intake air amount-adjusting valve has been controlled toward the open side based on the stop control start rotational speed; and target stop control start rotational speed-setting means for setting a target stop control start rotational speed that serves as a target of the stop control start rotational speed, based on the determined correlation and a predetermined final compression stroke rotational speed for stopping the piston at the predetermined position.

2. The stop control system as claimed in claim 1, further comprising:

basic value-calculating means for calculating the stop control start rotational speed corresponding to the predetermined final compression stroke rotational speed, based on the determined correlation, as a basic value of the target stop control start rotational speed; and averaging calculation means for calculating the target stop control start rotational speed by an averaging calculation using the calculated basic value and an immediately preceding value of the target stop control start rotational speed, wherein said averaging calculation means makes larger a degree of averaging of the basic value of the target stop control start rotational speed as the number of times of the averaging calculation is larger.

3. The stop control system as claimed in claim 1, further comprising:

detection means for detecting at least one of a temperature of intake air drawn into the engine, an atmospheric pressure, and a temperature of the engine; and target stop control start rotational speed-correcting means for correcting the target stop control start rotational speed according to at least one of the temperature of intake air drawn into the engine, the atmospheric pressure, and the temperature of the engine, which are detected.

4. The stop control system as claimed in claim 1, further comprising:

first stage intake air amount control means for controlling said intake air amount-adjusting valve to a first predetermined opening degree when the rotational speed of the engine becomes lower than a first stage control start rotational speed higher than the stop control start rotational speed, after said intake air amount control means has controlled said intake air amount-adjusting valve toward the closed side; and first stage control start rotational speed-setting means for setting the first stage control start rotational speed to a larger value as the target stop control start rotational speed is higher.

5. The stop control system as claimed in claim 1, further comprising:

first stage intake air amount control means for controlling said intake air amount-adjusting valve to a first predetermined opening degree when the rotational speed of the engine becomes lower than a first stage control start rotational speed higher than the stop control start rotational speed, after said intake air amount control means has controlled said intake air amount-adjusting valve toward the closed side; and first predetermined opening degree-setting means for setting the first predetermined opening degree to a larger value as the target stop control start rotational speed is higher.

6. A stop control system for an internal combustion engine, which controls a stop position of a piston of the engine to a predetermined position during stoppage of the engine by controlling an intake air amount, comprising:

an intake air amount-adjusting valve for adjusting the intake air amount;

rotational speed-detecting means for detecting a rotational speed of the engine;

intake air amount control means for controlling an opening degree of said intake air amount-adjusting valve toward a closed side when a command for stopping the engine is issued, and thereafter toward an open side;

final compression stroke rotational speed-obtaining means for obtaining the rotational speed of the engine in a final compression stroke immediately before the engine is stopped, as a final compression stroke rotational speed;

correlation determining means for determining a correlation between the opening degree of said intake air amount-adjusting valve and the final compression stroke rotational speed, based on the opening degree of said intake air amount-adjusting valve and the final compression stroke rotational speed obtained when the opening degree of said intake air amount-adjusting valve has been controlled toward the open side; and target opening-setting means for setting a target opening degree that serves as a target of the opening degree of said intake air amount-adjusting valve, based on the determined correlation and a predetermined final compression stroke rotational speed for stopping the piston at the predetermined position.

7. The stop control system as claimed in claim 6, further comprising:

basic value-calculating means for calculating the opening degree of said intake air amount-adjusting value corresponding to the predetermined final compression stroke rotational speed, based on the determined correlation, as a basic value of the target opening degree of said intake air amount-adjusting value; and averaging calculation means for calculating the target opening degree by an averaging calculation using the calculated basic value and an immediately preceding value of the target opening degree, wherein said averaging calculation means makes larger a degree of averaging of the basic value of the target opening degree as the number of times of the averaging calculation is larger.

8. The stop control system as claimed in claim 6, further comprising:

detection means for detecting at least one of a temperature of intake air drawn into the engine, an atmospheric pressure, and a temperature of the engine; and target opening degree-correcting means for correcting the target opening degree according to at least one of the temperature of intake air drawn into the engine, the atmospheric pressure, and the temperature of the engine, which are detected.

9. The stop control system as claimed in claim 6, further comprising:

first stage intake air amount control means for controlling said intake air amount-adjusting valve to a first predetermined opening degree when the rotational speed of the engine becomes lower than a first stage control start rotational speed higher than the stop control start rotational speed for controlling said intake air amount-adjusting value toward the open side, after said intake air amount control means has controlled said intake air amount-adjusting valve toward the closed side; and first stage control start rotational speed-setting means for setting the first stage control start rotational speed to a smaller value as the target opening degree is larger.

10. The stop control system as claimed in claim 6, further comprising:

first stage intake air amount control means for controlling said intake air amount-adjusting valve to a first predetermined opening degree when the rotational speed of the engine becomes lower than a first stage control start rotational speed higher than the stop control start rotational speed for controlling said intake air amount-adjusting value toward the open side, after said intake air amount control means has controlled said intake air amount-adjusting valve toward the closed side; and first predetermined opening degree-setting means for setting the first predetermined opening degree to a smaller value as the target opening degree is larger.

11. A stop control method for an internal combustion engine, which controls a stop position of a piston of the engine to a predetermined position during stoppage of the engine by controlling an intake air amount, comprising:

a step of detecting a rotational speed of the engine;

a step of controlling an intake air amount-adjusting valve for adjusting the intake air amount, toward a closed side when a command for stopping the engine is issued, and thereafter when the detected rotational speed of the engine becomes lower than a stop control start rotational speed, controlling the intake air amount-adjusting valve toward an open side;

a step of obtaining the rotational speed of the engine in a final compression stroke immediately before the engine is stopped, as a final compression stroke rotational speed;

a step of determining a correlation between the stop control start rotational speed and the final compression stroke rotational speed, based on the stop control start rotational speed and the final compression stroke rotational speed obtained when the intake air amount-adjusting valve has been controlled toward the open side based on the stop control start rotational speed; and a step of setting a target stop control start rotational speed that serves as a target of the stop control start rotational speed, based on the determined correlation and a predetermined final compression stroke rotational speed for stopping the piston at the predetermined position.

12. The stop control method as claimed in claim 11, further comprising:

a step of calculating the stop control start rotational speed corresponding to the predetermined final compression stroke rotational speed, based on the determined correlation, as a basic value of the target stop control start rotational speed; and a step of calculating the target stop control start rotational speed by an averaging calculation using the calculated basic value and an immediately preceding value of the target stop control start rotational speed, wherein a degree of averaging of the basic value of the target stop control start rotational speed is made larger as the number of times of the averaging calculation is larger.

13. The stop control method as claimed in claim 11, further comprising:

a step of detecting at least one of a temperature of intake air drawn into the engine, an atmospheric pressure, and a temperature of the engine; and a step of correcting the target stop control start rotational speed according to at least one of the temperature of intake air drawn into the engine, the atmospheric pressure, and the temperature of the engine, which are detected.

14. The stop control method as claimed in claim 11, further comprising:

a step of controlling the intake air amount-adjusting valve to a first predetermined opening degree when the rotational speed of the engine becomes lower than a first stage control start rotational speed higher than the stop control start rotational speed, after the intake air amount-adjusting valve has been controlled toward the closed side; and a step of setting the first stage control start rotational speed to a larger value as the target stop control start rotational speed is higher.

15. The stop control method as claimed claim 11, further comprising:

a step of controlling the intake air amount-adjusting valve to a first predetermined opening degree when the rotational speed of the engine becomes lower than a first stage control start rotational speed higher than the stop control start rotational speed, after the intake air amount-adjusting valve has been controlled toward the closed side; and a step of setting the first predetermined opening degree to a larger value as the target stop control start rotational speed is higher.

16. A stop control method for an internal combustion engine, which controls a stop position of a piston of the engine to a predetermined position during stoppage of the engine by controlling an intake air amount, comprising:

a step of detecting a rotational speed of the engine;

a step of controlling an opening degree of an intake air amount-adjusting valve for adjusting the intake air amount, toward a closed side when a command for stopping the engine is issued, and thereafter toward an open side;

a step of obtaining the rotational speed of the engine in a final compression stroke immediately before the engine is stopped, as a final compression stroke rotational speed;

a step of determining a correlation between the opening degree of the intake air amount-adjusting valve and the final compression stroke rotational speed, based on the opening degree of the intake air amount-adjusting valve and the final compression stroke rotational speed obtained when the opening degree of the intake air amount-adjusting valve has been controlled toward the open side; and a step of setting a target opening degree that serves as a target of the opening degree of the intake air amount-adjusting valve, based on the determined correlation and a predetermined final compression stroke rotational speed for stopping the piston at the predetermined position.

17. The stop control method as claimed in claim 16, further comprising:

a step of calculating the opening degree of the intake air amount-adjusting value corresponding to the predetermined final compression stroke rotational speed, based on the determined correlation, as a basic value of the target opening degree of the intake air amount-adjusting value; and a step of calculating the target opening degree by an averaging calculation using the calculated basic value and an immediately preceding value of the target opening degree, wherein a degree of averaging of the basic value of the target opening degree is made larger as the number of times of the averaging calculation is larger.

18. The stop control method as claimed in claim 16, further comprising:

a step of detecting at least one of a temperature of intake air drawn into the engine, an atmospheric pressure, and a temperature of the engine; and a step of correcting the target opening degree according to at least one of the temperature of intake air drawn into the engine, the atmospheric pressure, and the temperature of the engine, which are detected.

19. The stop control method as claimed in any claim 16, further comprising:

a step of controlling the intake air amount-adjusting valve to a first predetermined opening degree when the rotational speed of the engine becomes lower than a first stage control start rotational speed higher than the stop control start rotational speed for controlling the intake air amount-adjusting value toward the open side, after the intake air amount-adjusting valve has been controlled toward the closed side; and a step of setting the first stage control start rotational speed to a smaller value as the target opening degree is larger.

20. The stop control method as claimed in claim 16, further comprising:

a step of controlling the intake air amount-adjusting valve to a first predetermined opening degree when the rotational speed of the engine becomes lower than a first stage control start rotational speed higher than the stop control start rotational speed for controlling the intake air amount-adjusting value toward the open side, after the intake air amount-adjusting valve has been controlled toward the closed side; and a step of setting the first predetermined opening degree to a smaller value as the target opening degree is larger.

* * * * *